US009745913B2

(12) United States Patent
Fujime

(10) Patent No.: US 9,745,913 B2
(45) Date of Patent: Aug. 29, 2017

(54) FUEL INJECTION CONTROLLER

(71) Applicant: YAMAHA HATSUDOKI KABUSHIKI KAISHA, Iwata-shi, Shizuoka (JP)

(72) Inventor: Yoko Fujime, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 110 days.

(21) Appl. No.: 14/210,692

(22) Filed: Mar. 14, 2014

(65) Prior Publication Data

US 2014/0288805 A1 Sep. 25, 2014

(30) Foreign Application Priority Data

Mar. 22, 2013 (JP) ..... 2013-060591

(51) Int. Cl.

*F02D 41/14* (2006.01)
*F02D 41/30* (2006.01)
*F02D 41/24* (2006.01)

(52) U.S. Cl.

CPC ..... *F02D 41/3005* (2013.01); *F02D 41/1454* (2013.01); *F02D 41/2454* (2013.01)

(58) Field of Classification Search

CPC ..... F02D 41/3005; F02D 41/1454; F02D 41/2454; F02D 41/2441; F02D 41/248;
(Continued)

(56) References Cited

U.S. PATENT DOCUMENTS 4,186,691 A * 2/1980 Takase ..... F02D 41/1481 123/325
4,664,086 A * 5/1987 Takeda ..... F02D 41/2454 123/674

(Continued)

FOREIGN PATENT DOCUMENTS

CN 102536485 A 7/2012
DE 198 59 509 A1 9/1999

(Continued)

OTHER PUBLICATIONS

Official Communication issued in corresponding European Patent Application No. 14156979.8 mailed on Sep. 25, 2014.

(Continued)

*Primary Examiner* — Hai Huynh
*Assistant Examiner* — Gonzalo Laguarda
(74) *Attorney, Agent, or Firm* — KEATING AND BENNETT, LLP

(57) ABSTRACT

A fuel injection controller includes an oxygen sensor that responds to an oxygen concentration inside an exhaust passage, and an injection amount control unit programmed to control a fuel injection amount based on the output of the oxygen sensor. The injection amount control unit includes an injection amount correction value computing unit that determines an injection amount correction value based on the output of the oxygen sensor, a short-time learning value computing unit that determines a short-time learning value based on the injection amount correction value, a long-time learning value computing unit that determines a long-time learning value based on the short-time learning value; a feedback correction amount computing unit that computes a feedback correction amount, an injection amount control value computing unit that computes a control value of the (Continued)

fuel injection amount, and a long-time learning value holding unit that holds the long-time learning value.

10 Claims, 10 Drawing Sheets

(58) Field of Classification Search
CPC ..... F02D 41/1441; F02D 41/0235; F02D 41/1455; F02D 41/1456; F02D 41/1461; F02D 41/2445; F02D 41/2451
USPC ..... 123/672, 674; 701/109
See application file for complete search history.

(56) References Cited

U.S. PATENT DOCUMENTS

| | | | | |
|---|---|---|---|---|
| 4,905,653 | A | 3/1990 | Manaka et al. | |
| 5,343,970 | A * | 9/1994 | Severinsky | B60K 6/387 180/165 |
| 5,778,666 | A * | 7/1998 | Cullen | F01N 3/0842 123/675 |
| 6,101,809 | A * | 8/2000 | Ishizuka | F01N 3/0814 123/674 |
| 6,161,531 | A * | 12/2000 | Hamburg | F02D 41/0255 123/674 |
| 9,026,340 | B2 * | 5/2015 | Kuratani | F01N 3/30 123/480 |
| 2003/0196622 | A1 | 10/2003 | Wada et al. | |
| 2009/0211545 | A1 * | 8/2009 | Satou | F01M 13/0011 123/41.86 |
| 2011/0239750 | A1 | 10/2011 | Abe et al. | |
| 2011/0315108 | A1 * | 12/2011 | Nakagawa | F02D 41/1456 123/179.4 |
| 2012/0166068 | A1 | 6/2012 | Kuratani et al. | |

FOREIGN PATENT DOCUMENTS

| | | | |
|---|---|---|---|
| DE | 10 2005 062 116 | A1 | 6/2007 |
| EP | 0 803 646 | A2 | 10/1997 |
| EP | 1 529 940 | A2 | 5/2005 |
| EP | 2 261 490 | A1 | 12/2010 |
| JP | 61-272444 | A | 12/1986 |
| JP | 62-233440 | A | 10/1987 |
| JP | 02-163442 | A | 6/1990 |
| JP | 5-68632 | B2 | 9/1993 |
| JP | 11-353006 | A | 12/1999 |
| JP | 2001-329894 | A | 11/2001 |
| JP | 2003-314217 | A | 11/2003 |
| JP | 2010-048125 | A | 3/2010 |
| JP | 2012-136970 | A | 7/2012 |
| WO | 2007/065852 | A1 | 6/2007 |

OTHER PUBLICATIONS

Official Communication issued in corresponding Chinese Patent Application No. 201410108649.5, mailed on Dec. 4, 2015.

* cited by examiner

C : INJECTION AMOUNT CORRECTION VALUE
Δs : SKIP VARIATION AMOUNT
Δ : CORRECTION VARIATION AMOUNT

S: SHORT-TIME LEARNING VALUE
L: LONG-TIME LEARNING VALUE
LU: LONG-TIME LEARNING UPDATE AMOUNT

FUEL INJECTION CONTROLLER

BACKGROUND OF THE INVENTION

1. Field of the Invention

The present invention relates to a fuel injection controller that controls an injection amount of a fuel injector included in an engine of a vehicle.

2. Description of the Related Art

Japanese Unexamined Patent Publication No. 2001-329894 discloses a fuel system abnormality diagnosis apparatus for an internal combustion engine. In this document, a feedback correction factor is determined for performing feedback control of an air-fuel ratio of an exhaust gas in a vicinity of a target air-fuel ratio. Also, a learning correction factor is determined by learning a deviation amount of the actual air-fuel ratio from the target air-fuel ratio. A required fuel injection amount is calculated using the feedback correction factor and the learning correction factor. The learning correction factor is stored in a backup RAM that is backed up by a battery.

SUMMARY OF THE INVENTION

Upon continuing research on fuel injection controllers and also performing research on the prior art described above, the inventor of the present application discovered the following challenges.

That is, when the learning speed is made faster, although the learning value (the learning correction amount) follows the feedback correction factor quickly, appropriate fuel injection control is not necessarily possible because the learning value is more easily influenced by short-term fluctuations and medium-term fluctuations of the engine state. Examples of specific causes of short-term fluctuations of the engine state include temporary occurrences of rich/lean states due to acceleration/deceleration, temporary occurrence of a lean state during recovery from cutting the fuel, occurrence of a lean state due to running out of gas, etc. One example of specific causes of medium-term fluctuations of the engine state is the type of fuel (high-octane gasoline, regular gasoline, low-grade fuel, alcohol fuel, etc.). The learning value, with which the value during the previous operation is inherited, should not reflect such short-term and medium-term fluctuations. It is thus preferable for the learning speed to be set so that only long-term fluctuations of the engine state are reflected. Long-term fluctuations are caused, for example, by individual variations, aging, etc., and are semi-perpetual fluctuations.

However, with the arrangement of Japanese Unexamined Patent Publication No. 2001-329894, if the learning value is made to absorb only the long-term fluctuations of the engine state, the feedback correction factor will have to accommodate not only the short-term fluctuations of the engine state but also the medium-term fluctuations. Therefore, in a state where the feedback control is interrupted, the control of the fuel injection amount is dependent on the learning value that accommodates only the long-term fluctuations. An appropriate fuel injection amount thus cannot be set. Also, upon recovery from the interruption of feedback control, both the medium-term fluctuations and the short-term fluctuations must be absorbed by the feedback correction factor. The follow-up performance is thus insufficient. Thus, there is room for improvement from the standpoint of improvement in fuel efficiency, etc.

A preferred embodiment of the present invention provides a fuel injection controller that controls a fuel injection amount of a fuel injector that is included in an engine of a vehicle. The fuel injection controller includes an oxygen sensor that responds to an oxygen concentration inside an exhaust passage through which an exhaust of the engine passes, and an injection amount control unit that controls the fuel injection amount based on an output of the oxygen sensor. The injection amount control unit includes an injection amount correction value computing unit that determines an injection amount correction value based on the output of the oxygen sensor; a short-time learning value computing unit that determines, based on the injection amount correction value; a short-time learning value that is updated at a predetermined short-time learning speed; a long-time learning value computing unit that determines, based on the short-time learning value, a long-time learning value that is updated at a long-time learning speed that is slower than the short-time learning speed; a feedback correction amount computing unit that computes a feedback correction amount based on a sum of the injection amount correction value, the short-time learning value, and the long-time learning value; an injection amount control value computing unit that computes a control value of the fuel injection amount using the feedback correction amount; and a long-time learning value holding unit that holds (stores) the long-time learning value. When the engine is started, the long-time learning value computing unit reads and uses a previous long-time learning value from the long-time learning value holding unit while, on the other hand, the short-time learning value computing unit starts computing the short-time learning value anew without inheriting a previous short-time learning value.

With this arrangement, the feedback correction amount for determining the control value of the fuel injection amount is determined using the sum of the injection amount correction value, the short-time learning value, and the long-time learning value. The injection amount correction value is determined based on the output of the oxygen sensor that responds to the oxygen concentration inside the exhaust passage and therefore fluctuates promptly in accordance with the state of the engine exhaust. The short-time learning value is updated, based on the injection amount correction value, at the short-time learning speed. The long-time learning value is updated, based on the short-time learning value, at the long-time learning speed. The short-time learning speed is faster than the long-time learning speed. That is, the short-time learning value fluctuates more rapidly than the long-time learning value.

The injection amount correction value thus transitions gradually to the short-time learning value in accordance with the short-time learning speed, and the short-time learning value gradually transitions to the long-time learning value in accordance with the long-time learning speed. Influences of long-term fluctuations of the engine state are thus absorbed by the long-time learning value, influences of medium-term fluctuations of the engine state are absorbed by the short-time learning value, and influences of short-term fluctuations of the engine state are absorbed by the injection amount correction value. Therefore, even if the updating of the injection amount correction value is interrupted temporarily and the injection amount correction value is reset, an appropriate fuel injection amount that is in accordance with the state of the engine is set using the short-time learning value and the long-time learning value. Also, even upon recovery from the interruption of updating of the injection amount correction value, the injection amount correction value is required to absorb just the influences of short-term fluctuations and an appropriate fuel injection amount is thus set promptly. The fuel efficiency is thus improved, and with an engine that includes a catalyst for exhaust purification, the degree of cleanness of the exhaust is improved.

On the other hand, during startup of the engine, whereas the long-time learning value of the previous operation is inherited, with the short-time learning value, the value of the previous operation is not inherited. Influences of the short-time learning are thus prevented from becoming permanent and even if the learning speed is set comparatively high, it will not affect the subsequent operation inadvertently. Also, by providing the short-time learning value, the learning speed of the long-time learning value is made sufficiently slow to reduce influences of the medium-term fluctuations on the long-time learning value. The long-time learning value is inherited in the subsequent operation and appropriate fuel injection control is therefore be realized even before the feedback control using the output of the oxygen sensor is started during the startup of the engine.

In a preferred embodiment of the present invention, the short-time learning value computing unit updates the short-time learning value so that the injection amount correction value approaches zero, and the long-time learning value computing unit updates the long-time learning value such that the short-time learning value approaches zero.

With this arrangement, fluctuation of the injection amount correction value transitions to the short-time learning value, and fluctuation of the short-time learning value transitions to the long-time learning value. The injection amount correction value thus approaches zero as the learning proceeds and the fuel injection control is thus performed appropriately even in an open loop control state where the updating of the injection amount correction value is interrupted temporarily and the injection amount correction value is reset.

In a preferred embodiment of the present invention, the injection amount control unit includes a feedback control interrupting unit that interrupts the computing by the injection amount correction value computing unit when a predetermined interruption condition is established to interrupt the feedback control based on the output of the oxygen sensor, the short-time learning value computing unit holds (stores) the short-time learning value for a predetermined hold time when the feedback control is interrupted and, when the time during which the feedback control is interrupted reaches the predetermined hold time, makes the short-time learning value approach zero gradually, and the feedback correction amount computing unit computes a sum of the short-time learning value and the long-time learning value as the feedback correction amount when the feedback control is interrupted.

With this arrangement, when the predetermined interruption condition is established, the feedback control is interrupted and an open loop control of computing the control value of the fuel injection amount using the sum of the short-time learning value and the long-time learning value as the feedback correction amount is performed. The short-time learning value is a value in which the medium-term fluctuations of the engine state are absorbed and therefore appropriate fuel injection control is performed in comparison to a case of using only the long-time learning value in the open loop control. Also, in recovering from the open loop control to the feedback control, the fuel injection correction value is required to absorb just the influences of the short-term fluctuations of the engine state and its absolute value may thus be small. Appropriate fuel injection control is thus realized rapidly upon recovery to the feedback control.

Examples of the interruption condition include an air induction operation of introducing air into the exhaust passage is being performed, that a fuel cut control of setting the fuel injection amount to zero is being performed, etc. If a catalyst (in particular, a three-way catalyst) is disposed in the exhaust passage, purification of exhaust is performed in some cases by intentionally increasing the oxygen concentration inside the exhaust passage by performing the air induction of introducing secondary air (air that has not passed through a combustion chamber of the engine) into the exhaust passage. In this process, the oxygen concentration does not reflect the fuel ratio in the mixed gas supplied to the engine and it is thus appropriate to interrupt the feedback control. Also, by interrupting the feedback control during the fuel cut in which the fuel injection amount is set to zero, influences of the fuel cut during restart of fuel injection are prevented.

In a preferred embodiment of the present invention, when the absolute value of the injection amount correction value is greater than a predetermined high-speed learning threshold, the short-time learning value computing unit updates the short-time learning value at a high-speed short-time learning speed that is faster than the short-time learning speed. With this arrangement, the learning speed of the short-time learning value is increased when the value of the injection amount correction value is large. The absolute value of the injection amount correction value is thus made small in a short time, and therefore even if the updating of the injection amount correction value is temporarily interrupted and the injection amount correction value is reset, appropriate fuel injection control is realized quickly. That is, the injection amount correction value is made to transition to the short-time learning value quickly and an appropriate fuel injection amount is thus set in the process of open loop control during interruption of feedback control, etc.

Immediately after engine startup, the short-time learning is started anew and the short-time learning value thus takes on the initial value. The absolute value of the injection amount correction value thus takes on a large value due to absorbing the influences of the medium-term fluctuations of the engine as well. In such a case, the short-time learning value is updated at a high speed. Appropriate fuel injection control is thus performed promptly.

The fuel injection controller according to a preferred embodiment of the present invention further includes an abnormality judging unit that compares the absolute value of a sum of the short-time learning value and the long-time learning value with a predetermined abnormality threshold to judge whether or not there is an abnormality in the fuel supply system of the engine.

With this arrangement, the abnormality judgment of the fuel supply system is performed using the absolute value of the sum of the short-time learning value and the long-time learning value. Abnormality of the fuel supply system is thus judged based on medium-term and long-term fluctuations of the engine state. On the other hand, the injection amount correction value is not used for the abnormality judgment and the abnormality judgment is thus performed with the exclusion of the influences of short-term fluctuations of the engine state and the probability of erroneous judgment is thus reduced.

Moreover, the learning speed of the short-time learning value is comparatively fast and therefore when an abnormality occurs in the fuel supply system, the abnormality judgment is performed promptly. Also, the learning speed of the long-time learning value is set to a sufficiently low speed because the learning speed of the short-time learning value is fast. The abnormality judgment of the fuel supply system is thus performed appropriately without compromising the stability of fuel injection control. Also, with the short-time learning value, the previous value is not inherited during engine startup and therefore even if the short-time learning value becomes large due to a temporary phenomenon, it is not inherited in a subsequent operation. Both the abnormality judgment of the fuel supply system and the fuel injection control is thus performed appropriately.

The fuel injection controller according to a preferred embodiment of the present invention further includes an idling stop unit that automatically stops the engine when a predetermined idling stop condition is met and a restart unit that restarts the engine when a predetermined restart condition is met in an automatic stop state in which the engine is automatically stopped by the idling stop unit. When the engine is restarted by the restart unit, the short-time learning value computing unit inherits the previous short-time learning value.

With this arrangement, the fuel efficiency is improved by the engine being automatically stopped by the meeting of the idling stop condition. When the engine is automatically stopped by the idling stop unit, it may be considered that there is no problem in the fuel injection control and there is thus no problem in continuing to use the previous short-time learning value. Therefore, when the engine is restarted from the engine automatic stop state, the previous short-time learning value is inherited. The fuel injection control after engine restart is thus performed appropriately. On the other hand, if the engine is not automatically stopped by the idling stop control but is stopped due to the fuel injection control, etc., being inappropriate, the previous short-time learning value is not inherited in the subsequent engine startup. The previous short-time learning value is thus discarded and appropriate learning is started anew.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
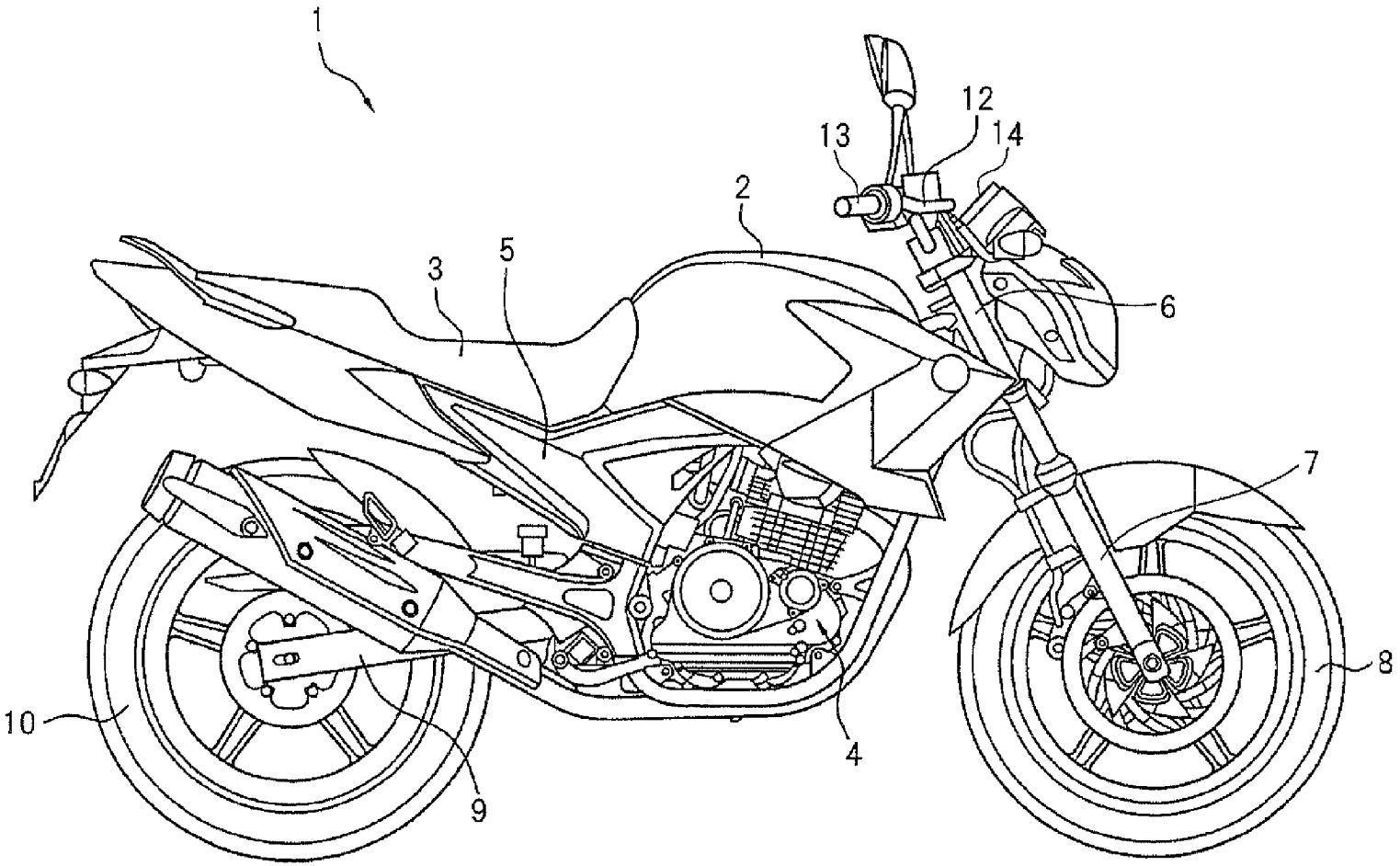
FIG. 1 is a side view of a vehicle to which a fuel injection controller according to a preferred embodiment of the present invention is applicable.

FIG. 1 is a side view of a vehicle to which a fuel injection controller according to a preferred embodiment of the present invention is applicable. The vehicle relating to this preferred embodiment is preferably a motorcycle 1, which is an example of a saddle type vehicle. The motorcycle 1 does not have to be of the type shown in FIG. 1 and may be a motorcycle of any type, such as a so-called scooter type, moped type, off-road type, on-road type, etc. Further, the form of the saddle type vehicle is not restricted to a motorcycle and may be an ATV (all-terrain vehicle), etc. A saddle type vehicle is a vehicle in which an occupant rides by straddling. Further, the vehicle to which the fuel injection controller of the present preferred embodiment is applicable is not restricted to a saddle type vehicle and the preferred embodiment is also applicable to a four-wheeled vehicle with a cabin, etc. To put it briefly, the fuel injection controller according to the present preferred embodiment is widely applicable to any vehicle that includes a fuel injection type engine.

The motorcycle 1 includes a fuel tank 2, a riding seat 3, an engine 4 that is an internal combustion engine, and a vehicle body frame 5 that supports these components. A rider and a passenger, who are the occupants, sit by straddling on the saddle type riding seat 3. A head pipe 6 is provided in front of the vehicle body frame 5 and a steering shaft (not shown) is supported by the head pipe 6. A handle 12 is fixed to an upper portion of the steering shaft. Front forks 7 are provided at a lower portion of the steering shaft. A front wheel 8 is rotatably supported by lower end portions of the front forks 7. A swing arm 9 is supported by the vehicle body frame 5 in a manner enabling swinging up and down. A rear wheel 10 is rotatably supported by a lower end portion of the swing arm 9. Elements are included to transmit a driving force of the engine 4 to the rear wheel 10.

A pair of grips to be held respectively by the right and left hands of the rider are provided at respective ends of the handle 12. Of these, one (for example, the right side grip as viewed by the rider seated on the riding seat 3) is an accelerator grip 13 that adjusts an output of the engine 4. The accelerator grip 13 is rotatably coupled to one end of the handle 12. The accelerator grip 13 is an example of an accelerator operating member. An indicator panel 14 is disposed in front of the handle 12. The indicator panel 14 includes meters, such as an engine speed meter, speedometer, etc., and various indicators.

Figure 2:
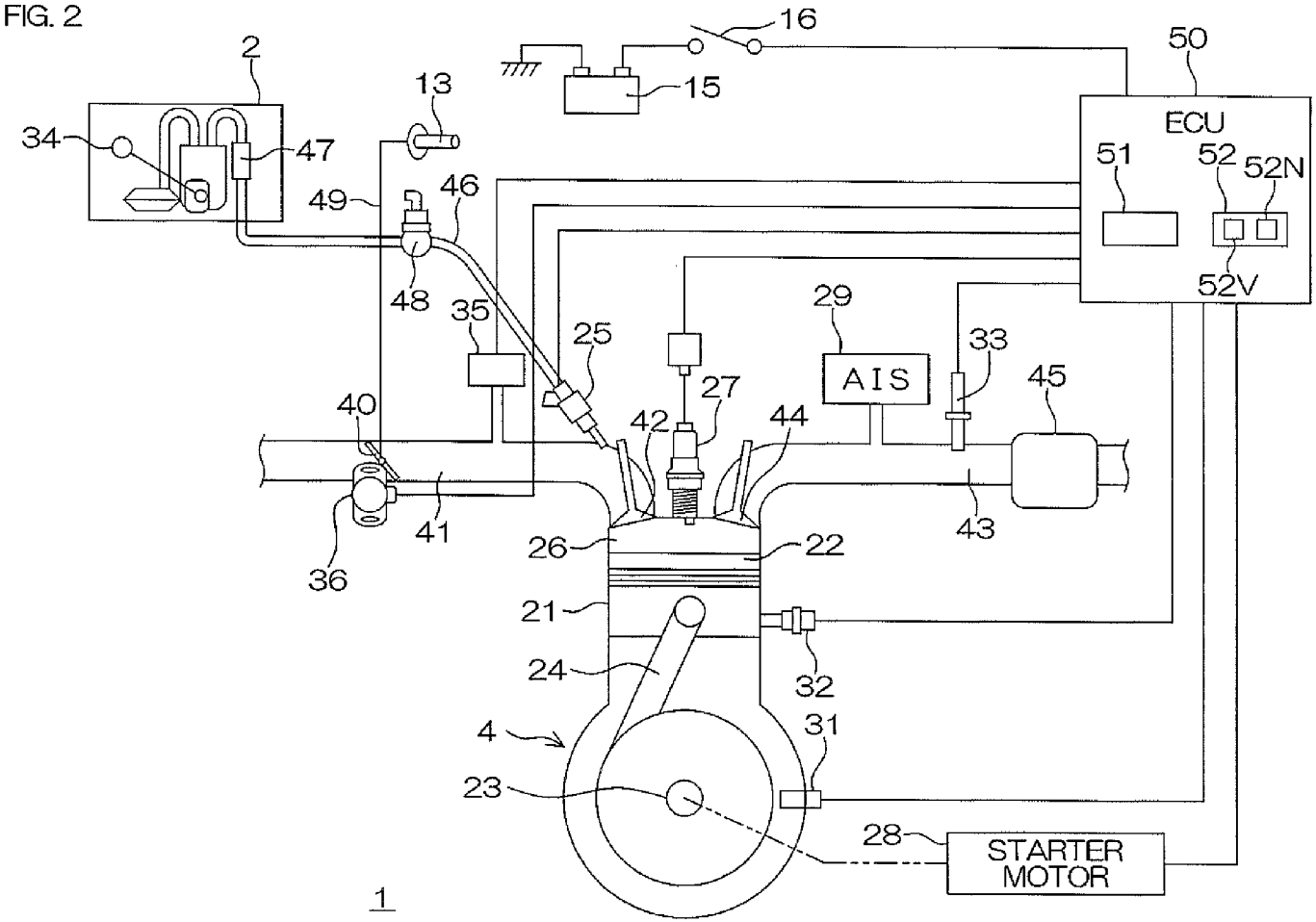
FIG. 2 is an arrangement diagram describing an arrangement related to an engine included in the vehicle.

FIG. 2 is an arrangement diagram describing an arrangement related to the engine 4. The engine 4 includes a cylinder 21, a piston 22 that reciprocates inside the cylinder 21, a crankshaft 23, and a connecting rod 24 connecting the piston 22 and the crankshaft 23. The engine 4 is, for example, preferably a four-stroke, single-cylinder engine that repeats a cycle made up of an intake stroke, a compression stroke, an expansion stroke, and an exhaust stroke. However, the engine 4 is not restricted to a single-cylinder engine and may be a multi-cylinder engine instead.

The engine 4 includes a fuel injection valve 25 that is a fuel injector that injects fuel, an igniter 27 that ignites the fuel inside a combustion chamber 26, and a starter motor 28 for startup. The engine 4 is provided with a rotational speed sensor 31 that detects the rotational speed of the crankshaft 23 and a temperature sensor 32 that detects the temperature of the engine 4. The rotational speed of the crankshaft 23 is the number of rotations per unit time of the crankshaft 23. In the following description, the rotational speed of the crankshaft 23 shall be referred to simply as the "engine speed." The temperature sensor 32 may be a sensor that detects the temperature of a portion of the engine 4 (for example, the cylinder 21). If the engine 4 is of a water-cooled type, the temperature sensor 32 may be a cooling water temperature sensor that detects the temperature of the cooling water. That is, the temperature sensor 32 may be a sensor that directly detects the temperature of the engine 4 or may be a sensor that indirectly detects the temperature of the engine 4 via the cooling water, etc.

The engine 4 includes an air intake passage 41 that introduces air into the combustion chamber 26, an intake valve 42 that opens and closes an interval between the air intake passage 41 and the combustion chamber 26, an exhaust passage 43 that discharges exhaust generated by combustion inside the combustion chamber 26, and an exhaust valve 44 that opens and closes a passage between the combustion chamber 26 and the exhaust passage 43. In the present preferred embodiment, the fuel injection valve 25 is arranged to inject fuel into the intake passage 41. However, the fuel injection valve 25 may be arranged to inject fuel directly into the combustion chamber 26 instead. Also, two types of fuel injection valves that inject fuel into the intake passage 41 and into the combustion chamber 26, respectively, may be included.

A catalyst 45 is provided in the exhaust passage 43. The catalyst 45 is, for example, a three-way catalytic converter and simultaneously removes hydrocarbons (HC), carbon monoxide (CO), and nitrogen oxides (NOx) that are hazardous components contained in the exhaust of the engine 4. More specifically, the catalyst may be an oxidation-reduction catalyst that oxidizes and thus renders harmless the hydrocarbons and carbon monoxide, and also reduces and thus renders harmless the nitrogen oxides. For high-efficiency oxidation and reduction, an air-fuel ratio in the mixed gas supplied to the engine 4 must be at a theoretical air-fuel ratio (stoichiometry). For this purpose, an oxygen sensor 33 is disposed in the exhaust passage 43 and the fuel injection amount is controlled based on its output signal. The oxygen sensor 33 detects the concentration of oxygen contained in the exhaust. More specifically, the oxygen sensor 33 is a sensor that outputs a rich signal when the air-fuel ratio in the mixed gas is in a rich region in which the fuel is excessive with respect to the theoretical air-fuel ratio and outputs a lean signal when the air-fuel ratio is in a lean region in which air is excessive.

An air induction system (AIS) 29 is connected to the exhaust passage 43. The air induction system 29 is a secondary air introduction system that is actuated to introduce secondary air to an upstream side of the catalyst 45 in the exhaust passage 43 when operation is being performed in a richer-than-stoichiometry state as in a warm-up operation. Secondary air is air that has not passed through the combustion chamber 26 and contains a large amount of oxygen.

The fuel tank 2 and the fuel injection valve 25 are connected by fuel piping 46. A fuel pump 47 supplying fuel toward the fuel piping 46 and a fuel sensor 34 detecting the fuel amount in the fuel tank 2 are provided in the interior of the fuel tank 2. The fuel sensor 34 may be a known sensor, such as a liquid level sensor, etc. The fuel contained in the fuel tank 2 may be gasoline or may be a mixed fuel that is a mixture of gasoline and ethanol. A fuel pressure regulator 48 used to maintain the pressure of the fuel substantially fixed is disposed in a middle of the fuel piping 46. A fuel supply system includes the fuel tank 2, the fuel injection valve 25, the fuel piping 46, the fuel pump 47, the fuel pressure regulator 48, etc.

A pressure sensor 35 that detects an intake pipe pressure that is an internal pressure of the air intake passage 41 is provided in the air intake passage 41. A throttle valve 40 is disposed in the air intake passage 41. The throttle valve 40 is coupled to a throttle wire 49. The throttle wire 49 is coupled to the accelerator grip 13 provided at one end of the handle 12. The opening degree of the throttle valve 40 is thus adjusted by the rider rotating the accelerator grip 13 and the output (engine speed) of the engine 4 is thus adjusted. A throttle opening degree sensor 36 is attached to the throttle valve 40. The throttle opening degree sensor 36 detects the position of the throttle valve 40 and outputs a signal expressing the opening degree.

The motorcycle 1 includes an ECU (electronic control unit) 50 as an engine control unit that controls of the engine 4. The motorcycle 1 further includes a battery 15 and a main switch 16. When the main switch 16 is turned ON by a user, the battery 15 and the ECU 50 are put in a conducting state and power is supplied to the ECU 50. The ECU 50 includes a computing portion 51 programmed to execute various computations and a storage portion 52 storing various information and control programs that perform the controls to be described below. The computing portion 51 includes a CPU and the storage portion 52 includes a ROM and a RAM. In the present preferred embodiment, the storage portion 52 includes a volatile memory 52V that loses the stored contents when the main switch 16 is cut off, and a programmable nonvolatile memory 52N that holds the stored contents even when the main switch 16 is cut off.

Figure 3:
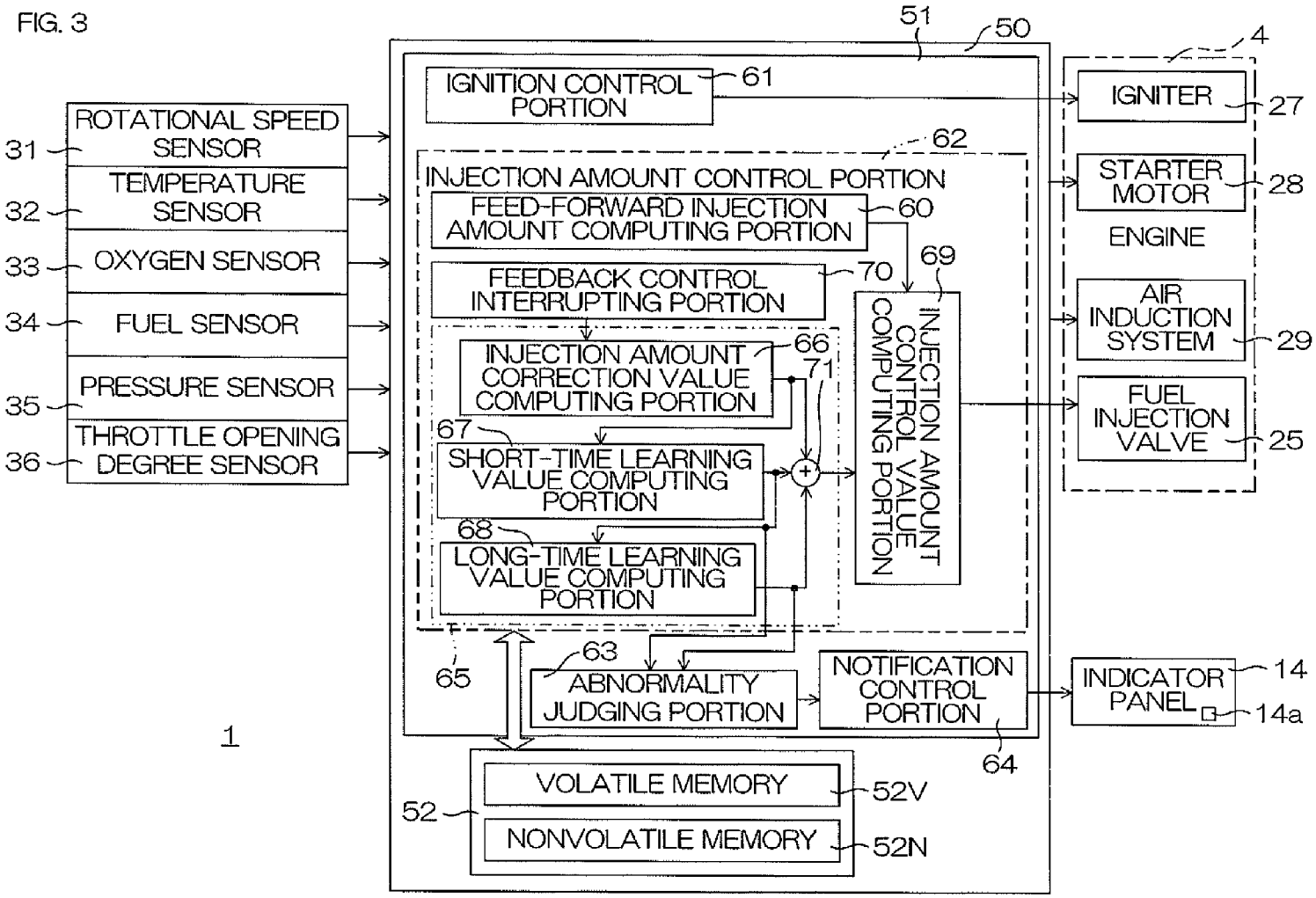
FIG. 3 is a block diagram describing a functional arrangement related to control of the engine.

FIG. 3 is a block diagram describing a functional arrangement related to control of the engine 4. The above-mentioned sensors are connected to the ECU 50 and detection signals are input into the ECU 50 from the respective sensors. Specifically, the ECU 50 is connected to the rotational speed sensor 31, the temperature sensor 32, the oxygen sensor 33, the fuel sensor 34, the pressure sensor 35, and the throttle opening degree sensor 36. The ECU 50 controls the engine 4 based on the detection values, etc., of these sensors.

The computing portion 51 acts as a plurality of function processing units by executing operation programs stored in the storage portion 52. The plurality of function processing units include an ignition control portion 61, an injection amount control portion 62, an abnormality judging portion 63, and a notification control portion 64.

The ignition control portion 61 controls the igniter 27. The injection amount control portion 62 controls the fuel injection valve 25 to control the fuel injection timing and the fuel injection amount. The injection amount control portion 62 increases or decreases the fuel injection amount with respect to an ordinary state or cuts the fuel injection as necessary. For example, until completion of warm-up of the engine 4 (during cold startup), the fuel injection amount is made greater than that in the ordinary state. The fuel injection amount is also increased to increase the output of the engine 4 during acceleration. Also, during deceleration, the fuel injection is cut. When fuel injection control that differs from that in the ordinary state is thus being performed, feedback control of the fuel injection amount based on the output signal of the oxygen sensor 33 is interrupted. The abnormality judging portion 63 executes an abnormality judging process that judges whether or not there is an abnormality in the fuel supply system. When the abnormality judging portion 63 judges that an abnormality has occurred in the fuel supply system, the notification control portion 64 executes a control to notify the rider of this event, etc. More specifically, an indicator 14*a* disposed in the indicator panel 14 is lit. The same warning may be issued using an indicator outside the indicator panel 14 as well.

The injection amount control portion 62 includes a feed-forward injection amount computing portion 60, a feedback correction amount computing portion 65, an injection amount control value computing portion 69, and a feedback control interrupting portion 70. The injection amount control portion 62 controls the fuel injection amount per single injection from the fuel injection valve 25 based on the outputs of the sensors. More specifically, the injection amount control portion 62 controls the fuel injection time.

The feed-forward injection amount computing portion 60 computes a feed-forward injection amount as a control value that is determined without feedback of the output signal of the oxygen sensor 33. The feedback correction amount computing portion 65 computes a feedback correction amount to correct the fuel injection amount based on the output signal of the oxygen sensor 33.

For example, the feed-forward injection amount computing portion 60 computes the feed-forward injection amount based on the output signals of the rotational speed sensor 31, the temperature sensor 32, the pressure sensor 35, the throttle opening degree sensor 36, etc. Specifically, the feed-forward injection amount computing portion 60 determines an intake air amount using a map in which the intake air amount is associated with the throttle opening degree and the engine speed or a map in which the intake air amount is associated with the intake pressure and the engine speed. Further, the feed-forward injection amount computing portion 60 determines a basic injection amount by which a target air-fuel ratio is achieved with respect to the air intake amount. The basic injection amount is adapted to an engine after warm-up in a state where the outside air is at ordinary temperature and 1 atmosphere. The feed-forward injection amount computing portion 60 thus corrects the basic injection amount based on the engine temperature, the outside air temperature, the outside air pressure, etc. Further, the feed-forward injection amount computing portion 60 performs correction in accordance with transient characteristics during acceleration or deceleration. The feed-forward injection amount resulting from correcting the basic injection amount is thus determined.

The feedback correction amount computing portion 65 uses the output signal of the oxygen sensor 33 to determine the feedback correction amount to correct the feed-forward injection amount. Specifically, the feedback correction amount computing portion 65 includes an injection amount correction value computing portion 66, a short-time learning value computing portion 67, a long-time learning value computing portion 68, and an adding portion 71.

The injection amount correction value computing portion 66 determines an injection amount correction value based on the output of the oxygen sensor 33. More specifically, if the output of the oxygen sensor 33 is the lean signal, the injection amount correction value is determined so that the next fuel injection amount (more specifically, the fuel injection time) increases. Even more specifically, when the output of the oxygen sensor 33 is the lean signal, the injection amount correction value computing portion 66 increases the injection amount correction value by a correction variation amount that is a fixed variation amount. On the other hand, if the output of the oxygen sensor 33 is the rich signal, the injection amount correction value is determined so that the next fuel injection amount (more specifically, the fuel injection time) decreases. Even more specifically, when the output of the oxygen sensor 33 is the rich signal, the injection amount correction value computing portion 66 decreases the injection amount correction value by the correction variation amount. Further, immediately after the output of the oxygen sensor 33 switches from the lean signal to the rich signal, the injection amount correction value computing portion 66 decreases the injection amount correction value by a skip variation amount that is greater than the correction variation amount. Similarly, immediately after the output of the oxygen sensor 33 switches from the rich signal to the lean signal, the injection amount correction value computing portion 66 increases the injection amount correction value by the skip variation amount.

The short-time learning value computing portion 67 determines a short-time learning value based on the injection amount correction value determined by the injection amount correction value computing portion 66. The short-time learning value computing portion 67 executes a learning computation of updating the short-time learning value by a short-time learning update amount, which is a fixed variation amount less than the correction variation amount, at each predetermined short-time learning value updating cycle (for example, of about 1 second). Specifically, the short-time learning value computing portion 67 uses the injection amount correction value immediately after the output of the oxygen sensor 33 switches between the lean signal and the rich signal, that is, immediately after a skip. More specifically, an arithmetic mean value of the respective injection amount correction values immediately after each of two skips that are adjacent in time is determined. The arithmetic mean value corresponds to an injection amount correction value that brings the oxygen concentration in the exhaust passage 43 close to stoichiometry (that is neither rich nor lean). The short-time learning value computing portion 67 increases or decreases the short-time learning value by the short-time learning update amount in accordance with the sign of the arithmetic mean value. The short-time learning value thus changes in a manner such that the injection amount correction value approaches zero. Whereas the injection amount correction value responds rapidly to the output of the oxygen sensor 33, a learning speed of the short-time learning value, that is, the short-time learning speed is slower than the change of the injection amount correction value. The short-time learning speed is expressed as a product of the updating cycle and the short-time learning update amount.

In the present preferred embodiment, the short-time learning update amount is switched between the two types of an ordinary update amount and a high-speed update amount in accordance with the magnitude of the absolute value of the injection amount correction value. Specifically, the short-time learning value computing portion 67 sets the ordinary update amount as the short-time learning update amount when the absolute value of the injection amount correction value is not more than a predetermined high-speed learning threshold. On the other hand, when the absolute value of the injection amount correction value exceeds the predetermined high-speed learning threshold, the short-time learning value computing portion 67 sets the high-speed update amount, which is greater than the ordinary update amount, as the short-time learning update amount. The speed of change of the short-time learning update amount, that is, the learning speed is thus made faster and high-speed learning is executed when the injection amount correction value is large.

Based on the short-time learning value determined by the short-time learning value computing portion 67, the long-time learning value computing portion 68 determines a long-time learning value that is updated at a long-time learning speed that is slower than the short-time learning speed. The long-time learning value computing portion 68 updates the long-time learning value by a long-time learning update amount, which is a fixed variation amount less than the short-time learning update amount, at each predetermined long-time learning value updating cycle (for example, of about 3 seconds). More specifically, the long-time learning value computing portion 68 updates the long-time learning value by a long-time learning update amount in accordance with the sign of the current short-time learning value. The long-time learning value is thus changed so as to make the short-time learning value gradually approach zero. The long-time learning update amount is of a value less than the short-time learning update amount and therefore even if the updating cycles are the same, the learning speed of the long-time learning value, that is, the long-time learning speed is slower than the short-time learning speed. The long-time learning speed is expressed as a product of the updating cycle and the long-time learning update amount.

The adding portion 71 adds the injection amount correction value computed by the injection amount correction value computing portion 66, the short-time learning value computed by the short-time learning value computing portion 67, and the long-time learning value computed by the long-time learning value computing portion 68 to determine a feedback correction amount.

The injection amount control value computing portion 69 determines a sum of the feed-forward injection amount determined by the feed-forward injection amount computing portion 60 and the feedback correction amount determined by the feedback correction amount computing portion 65 as a control value of the fuel injection amount as shown in the following formula (A). As mentioned above, the feedback correction amount is the sum of the injection amount correction value, the short-time learning value, and the long-time learning value. Using the control value of the fuel injection amount thus determined, the fuel injection amount (fuel injection time) of the fuel injection valve 25 is determined. The injection amount control portion 62 controls the operation of the fuel injection valve 25 based on the fuel injection time.

$$\begin{aligned}\text{Control value} &= \text{Feed-forward injection amount} + \text{Feedback correction amount} \\ &= \text{Feed-forward injection amount} + \text{Injection amount correction value} + \text{Short-time learning value} + \text{Long-time learning value}\end{aligned} \quad \text{(A)}$$

As the learning computation proceeds, the injection amount correction value transitions to the short-time learning value and the short-time learning value transitions to the long-time learning value. The injection amount correction value is thus made to approach zero, leading to a state where stable fuel injection control is performed.

The injection amount correction value computing portion 66 stores the determined injection amount correction value in the volatile memory 52V. Also, the short-time learning value computing portion 67 stores the determined short-time learning value in the volatile memory 52V. Further, the long-time learning value computing portion 68 stores the determined long-time learning value in the nonvolatile memory 52N. That is, in the present preferred embodiment, the nonvolatile memory 52N is used as a long-time learning value holding unit. When the main switch 16 is cut off and the power supply of the ECU 50 is lost, the injection amount correction value and the short-time learning value stored in the volatile memory 52V disappear while the long-time learning value is held inside the nonvolatile memory 52. Therefore, when the main switch 16 is turned on thereafter and the computations by the ECU 50 are started, the computations are started with the respective initial values in regard to the injection amount correction value and the short-time learning value. In regard to the long-time learning value, the learning computation is started upon inheriting the previous learning value held in the nonvolatile memory 52N.

When a predetermined interruption condition is met, the feedback control interrupting portion 70 stops the computation of the injection amount correction value by the injection amount correction value computing portion 66 and resets the injection amount correction value to zero. The feedback control of feeding back the output of the oxygen sensor 33 to control the fuel injection amount is thus interrupted. In the present preferred embodiment, interruption conditions include the following conditions a and b.

a: The air induction system 29 that introduces air into the exhaust passage 43 is in operation.

b: Fuel cut control, with which the fuel injection amount is set to zero, is being performed.

When either of the conditions a and b is met, the feedback control using the output of the oxygen sensor 33 is interrupted. During actuation of the air induction system 29, secondary air is introduced into the exhaust passage 43. The secondary air is air that has not passed through the combustion chamber 26 and contains a large amount of oxygen. Therefore, during actuation of the air induction system 29, the oxygen concentration detected by the oxygen sensor 33 is irrelevant to the fuel ratio in the air-fuel mixture (mixed gas) supplied to the combustion chamber 26. Therefore, if the output signal of the oxygen sensor 33 is fed back during actuation of the air induction system 29, the injection amount correction value will not be of an appropriate value. Also, during fuel cut control, which is executed when the throttle is fully closed for deceleration, etc., the output of the oxygen sensor 33 does not correspond to the fuel ratio in the mixed gas and feedback control thus should not be executed. Besides the above, the interruption conditions may include cases where operation at an air-fuel ratio apart from the theoretical air-fuel ratio (stoichiometry), etc., is desired.

The abnormality judging portion 63 judges whether or not there is an abnormality in the fuel supply system. Specifically, the abnormality judging portion 63 computes the absolute value of a sum of the short-time learning value and the long-time learning value as a judgment value as shown in the following formula (B).

$$\text{Judgment value} = |\text{Short-time learning value} + \text{Long-time learning value}| \quad \text{(B)}$$

The abnormality judging portion 63 judges that an abnormality has occurred in the fuel supply system when the judgment value exceeds an abnormality threshold and judges that there is no abnormality in the fuel supply system when the judgment value is not more than the abnormality threshold. When an abnormality occurs in the fuel supply system, the supply of fuel is not performed appropriately, the lean state or the rich state detected in the exhaust passage 43 is not resolved, and the injection amount correction value continues to take on a large absolute value. Accordingly, the short-time learning value takes on a large absolute value and further, the long-time learning value takes on a large absolute value. The judgment value thus exceeds the abnormality threshold, leading to the judgment of abnormality in the fuel supply system. Even if the injection amount correction value takes on a large value temporarily during acceleration or deceleration, this does not immediately influence the short-time learning value or the long-time learning value. Abnormality judgment of the fuel supply system is thus performed appropriately with the influences due to short-term fluctuations of the engine state being eliminated.

Examples of abnormality of the fuel supply system include abnormality of the fuel piping 46, abnormality of the fuel pump 47, abnormality of the fuel pressure regulator 48, abnormality of the fuel injection valve 25, etc. Any of these abnormalities is detected by monitoring the judgment value.

Upon judging that an abnormality is occurring in the fuel supply system, the abnormality judging portion 63 provides an abnormality judgment notification to the notification control portion 64. Upon receiving this, the notification control portion 64 executes control for notifying the abnormality to the rider. Specifically, the indicator 14*a* included in the indicator panel 14 is lit to notify the occurrence of abnormality to the rider.

Figure 4:
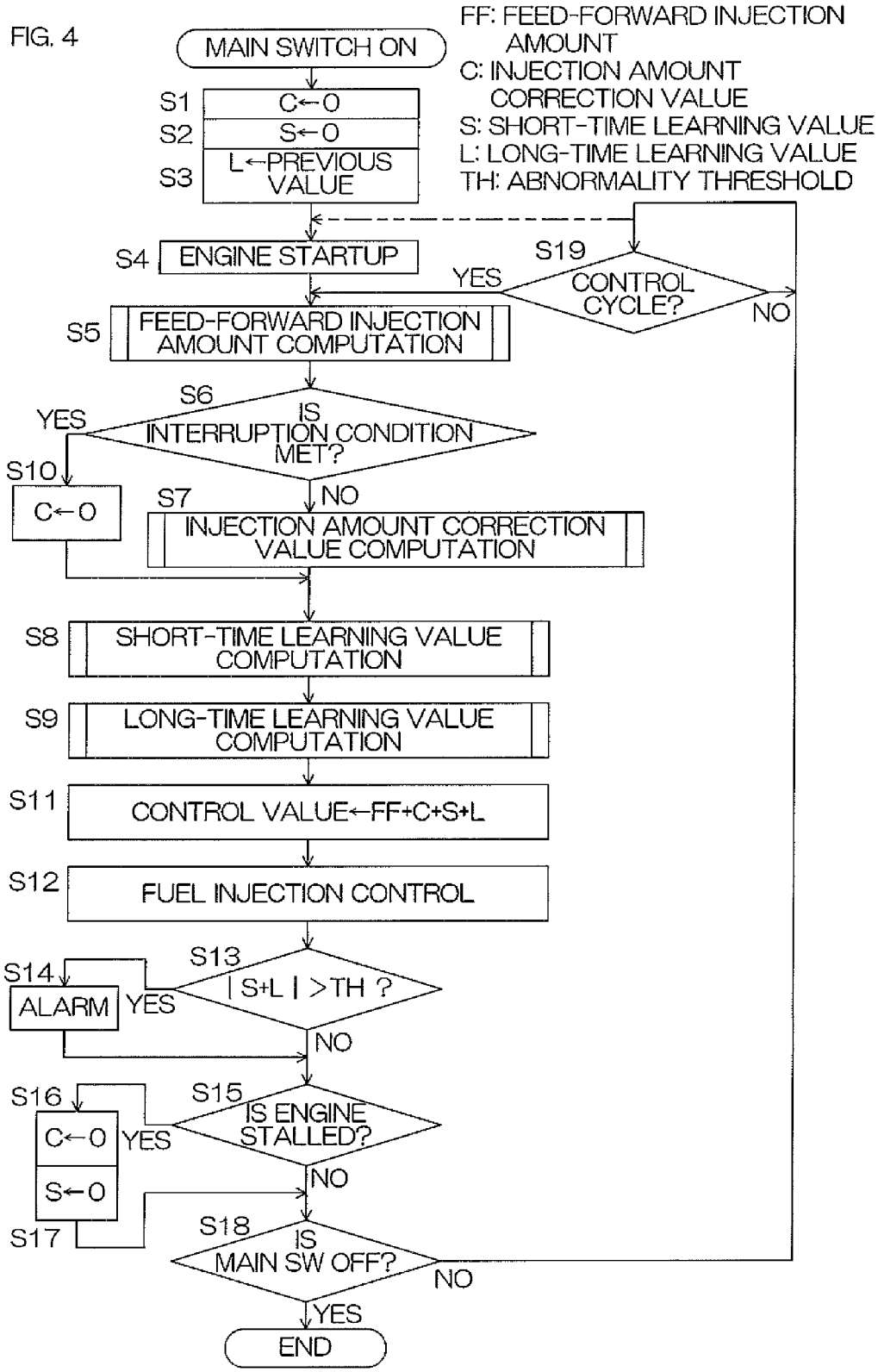
FIG. 4 is a flowchart describing an outline of processes performed by an ECU as an engine controller.

FIG. 4 is a flowchart describing an outline of processes performed by the ECU 50. When the main switch 16 is put in the conducting state and power is supplied to the ECU 50, the injection amount correction value C and the short-time learning value S are initialized to the respective initial values (for example, zero) (steps S1 and S2). On the other hand, the value stored in the nonvolatile memory 52N is loaded into the long-time learning value L (step S3). This value is the computation result of the long-time learning value L in the previous operation. That is, whereas in regard to the short-time learning value S, the learning result of the previous operation is not inherited, in regard to the long-time learning value L, the learning computation is started upon inheriting the learning result of the previous operation.

When startup operations of the engine 4 are performed by the rider and the engine 4 is started (step S4), the ECU 50 computes the feed-forward injection amount (step S5) and further judges whether or not an interruption condition is met (step S6). The startup operations include operation of the starter switch that actuates the starter motor 28, operation of the kick starter lever, etc. An interruption condition is as described above and is a condition under which the feedback control of controlling the fuel injection amount by feeding back the output signal of the oxygen sensor 33 should be interrupted.

If none of the interruption conditions is met (step S6: NO), the ECU 50 computes each of the injection amount correction value C, the short-time learning value S, and the long-time learning value L (steps S7, S8, and S9). If an interruption condition is met (step S6: YES), the ECU 50 assigns zero to the injection amount correction value C to invalidate the previous injection amount correction value C (step S10), omits the computation of the injection amount correction value C (step S7), and computes the short-time learning value S and the long-time learning value L (steps S8 and S9).

The ECU 50 then determines the sum of the feed-forward injection amount (FF), the injection amount correction value C, the short-time learning value S, and the long-time learning value L and uses the sum as the control value for the fuel injection amount (step S11). If an interruption condition is met, the injection amount correction value C is zero and the feedback correction amount is practically the sum of the short-time learning value S and the long-time learning value L. The control value is thus practically the sum of the feed-forward injection amount (FF), the short-time learning value S, and the long-time learning value L.

Using the control value thus determined, the ECU 50 controls the fuel injection time (that is, the fuel injection amount) of the fuel injection valve 25 (step S12).

The ECU 50 further determines the absolute value of the sum of the short-time learning value S and the long-time learning value L and uses it as the judgment value for the fuel supply system abnormality judgment. The ECU 50 compares the magnitudes of the judgment value and the abnormality threshold TH (step S13). If the judgment value exceeds the abnormality threshold TH (step S13: YES), the ECU 50 causes the indicator 14*a* to be lit to issue a warning to the rider (step S14). If the judgment value is not more than the abnormality threshold TH (step S13: NO), step S14 is omitted and the indicator 14*a* is maintained in the unlit state.

The ECU 50 further judges whether or not an engine stall has occurred (step S15). If an engine stall has occurred (step S15: YES), there is a possibility that the value of the fuel injection amount has become inappropriate temporarily and the ECU 50 thus initializes the injection amount correction value C and the short-time learning value S to zero (steps S16 and S17). The long-time learning value L hardly receives short-term influences and the value thereof is thus maintained even when an engine stall occurs.

The ECU 50 judges whether or not the main switch 16 has been cut off (step S18) and if the main switch 16 is cut off (step S18: YES), a predetermined ending process is executed and the power supply is cut off. If the main switch 16 is not cut off and the supply of power is continued (step S18: NO), the processes from step S5 are executed repeatedly at each predetermined control cycle (for example, at about 0.5 seconds) (step S19). After an engine stall, the processes from step S5 are repeated at each control cycle upon startup of the engine 4 (step S4).

Figure 5:
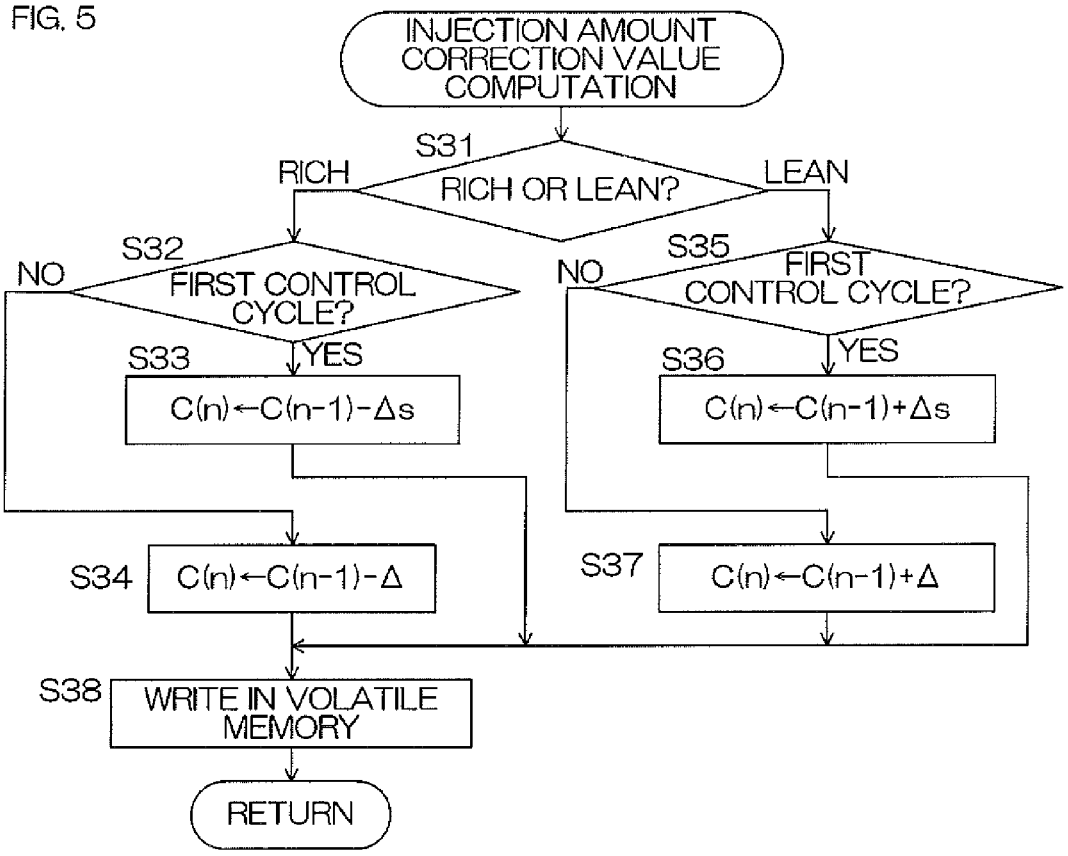
FIG. 5 is a flowchart describing an injection amount correction value computing process.

FIG. 5 is a flowchart describing a computing process for the injection amount correction value C (computing operation of the injection amount correction value computing portion 66). The injection amount correction value computing portion 66 judges whether or not the output of the oxygen sensor 33 is the rich signal or the lean signal (step S31).

In the case of the rich signal, the injection amount correction value computing portion 66 judges whether or not the current control cycle is the first control cycle after the output of the oxygen sensor 33 has become the rich signal (step S32). In the case of the first control cycle (step S32: YES), a value obtained by subtracting the skip variation amount Δs (where Δs>0) from the injection amount correction value C(n−1) (where n is a natural number) of the previous control cycle n−1 is assigned to the injection amount correction value C(n) of the current control cycle n as shown in the following formula (1) (step S33). In the control cycle immediately after startup of the engine 4, the injection amount correction values C(1) and C(0) are both zero and therefore C(1)=−Δs. However, immediately after engine startup, the injection amount correction value C(1) may be set equal to zero instead of applying the following formula.

$$C(n)=C(n-1)-\Delta s \quad (1)$$

If the current control cycle is the second or later control cycle after the output of the oxygen sensor 33 has become the rich signal (step S32: NO), a value obtained by subtracting the fixed correction variation amount Δ (where 0<Δ<Δs) from the injection amount correction value C(n−1) of the previous control cycle n−1 is assigned to the injection amount correction value C(n) of the current control cycle n as shown in the following formula (2) (step S34).

$$C(n)=C(n-1)-\Delta \quad (2)$$

On the other hand, if the output of the oxygen sensor 33 is the lean signal (step S31), the injection amount correction value computing portion 66 judges whether or not the current control cycle is the first control cycle after the output of the oxygen sensor 33 has become the lean signal (step S35). In the case of the first control cycle (step S35: YES), a value obtained by adding the skip variation amount Δs to the injection amount correction value C(n−1) of the previous control cycle n−1 is assigned to the injection amount correction value C(n) of the current control cycle n as shown in the following formula (3) (step S36). In the control cycle immediately after startup of the engine 4, the injection amount correction values C(1) and C(0) are both zero and therefore C(1)=+Δs. However, immediately after engine startup, the injection amount correction value C(1) may be set equal to zero instead of applying the following formula.

$$C(n)=C(n-1)+\Delta s \quad (3)$$

If the current control cycle is the second or later control cycle after the output of the oxygen sensor 33 has become the lean signal (step S35: NO), a value obtained by adding the fixed correction variation amount Δ to the injection amount correction value C(n−1) of the previous control cycle n−1 is assigned to the injection amount correction value C(n) of the current control cycle n as shown in the following formula (4) (step S37).

$$C(n)=C(n-1)+\Delta \quad (4)$$

The injection amount correction value C is thus determined so as to fluctuate by the correction variation amount Δ or the skip variation amount Δs at each control cycle. The determined correction value C is written into the volatile memory 52V (step S38). The injection amount correction value C thus loses its value when the main switch 16 is cut off and the supply of power to the ECU 50 stops.

Figure 6:
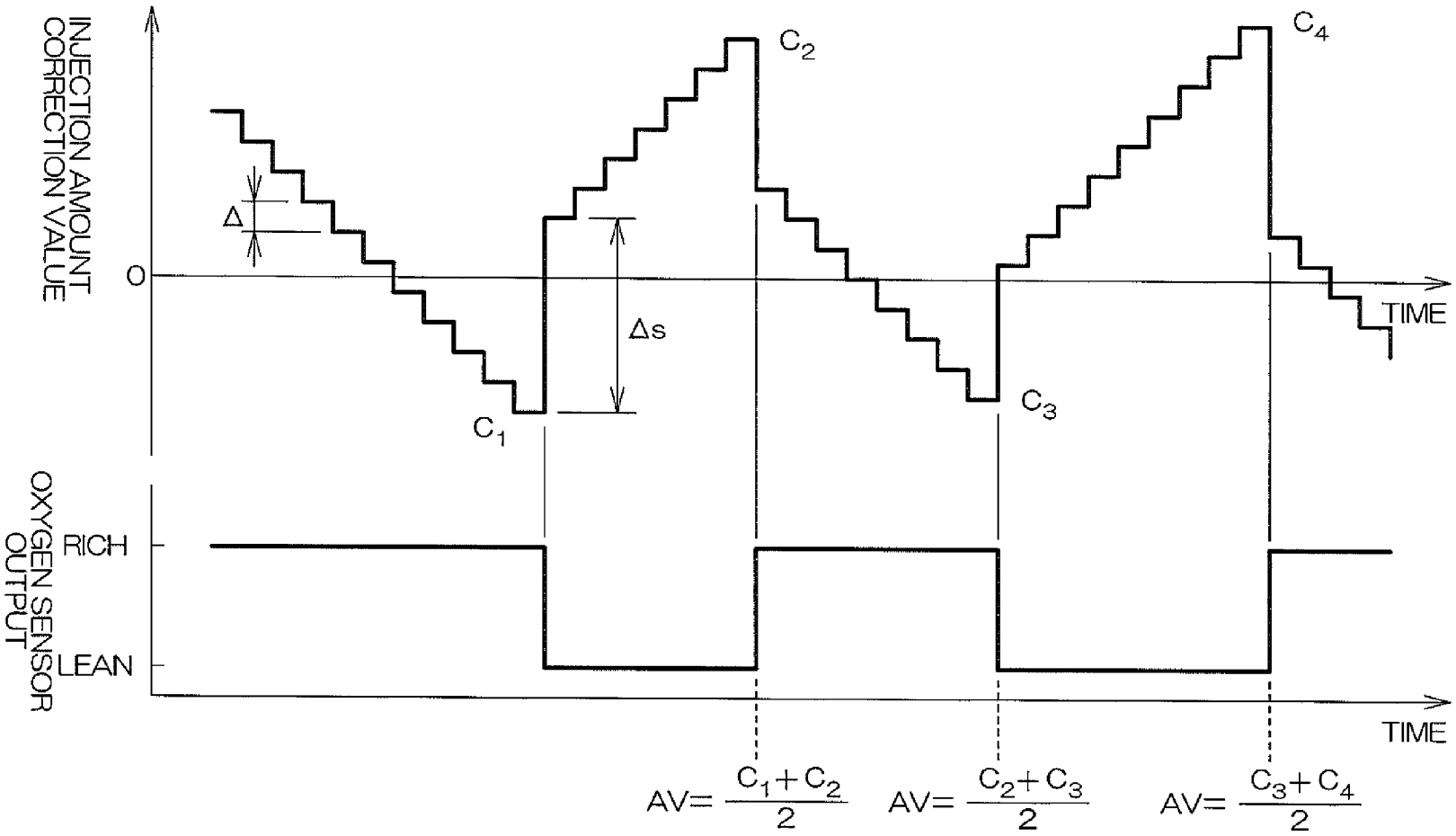
FIG. 6 is a time chart describing an example of fluctuation of the injection amount correction value.

FIG. 6 is a time chart describing an example of fluctuation of the injection amount correction value C. In a period in which the output of the oxygen sensor 33 is the lean signal, the injection amount correction value C is increased by the correction variation amount Δ at each control cycle. The fuel ratio in the mixed gas supplied to the combustion chamber 26 is thus increased and the output of the oxygen sensor 33 thus eventually switches to the rich signal. The injection amount correction value C is then decreased by the skip variation amount Δs (skip). In a period in which the output of the oxygen sensor 33 is the rich signal, the injection amount correction value C is decreased by the correction variation amount Δ at each control cycle. The fuel ratio in the mixed gas supplied to the combustion chamber 26 is thus decreased and the output of the oxygen sensor 33 thus eventually switches to the lean signal. The injection amount correction value C is then increased by the skip variation amount Δs (skip).

Figure 7:
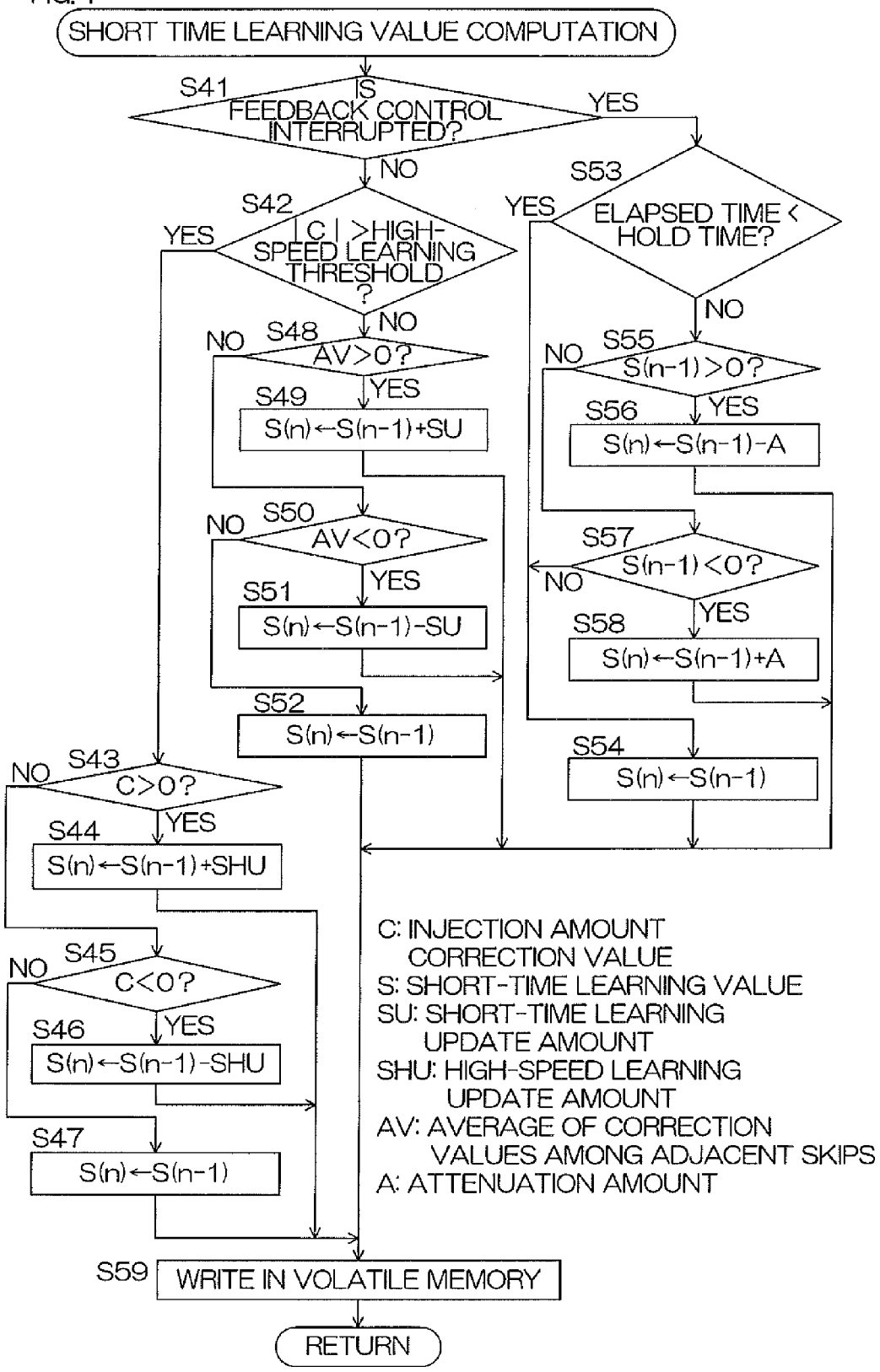
FIG. 7 is a flowchart describing a learning process for a short-time learning value.

FIG. 7 is a flowchart describing the learning process (computation operation of the short-time learning value computing portion 67) for the short-time learning value S. The short-time learning value computing portion 67 judges whether or not the feedback control of the fuel injection amount using the output of the oxygen sensor 33, that is, the updating of the injection amount correction value C is interrupted (step S41). If the feedback control is not interrupted (step S41: NO), the short-time learning value computing portion 67 further judges whether or not the absolute value of the injection amount correction value C exceeds the high-speed learning threshold (>0) (step S42).

If the absolute value of the injection amount correction value C exceeds the high-speed learning threshold (step S42: YES), the short-time learning value computing portion 67 updates the short-time learning value S in accordance with the sign of the injection amount correction value C. Specifically, if the injection amount correction value C is positive (step S43: YES), a value obtained by adding the high-speed learning update amount SHU (where SHU>0) to the short-time learning value S(n−1) of the previous control cycle n−1 is assigned to the short-time learning value S(n) of the current control cycle n as shown in the following formula (5) (step S44). In the control cycle immediately after startup of the engine 4, the short-time learning values S(1) and S(0) are both zero and therefore S(1)=+SHU. However, immediately after engine startup, the short-time learning value S(1) may be set equal to zero instead of applying the following formula.

$$S(n)=S(n-1)+SHU \quad (5)$$

If the injection amount correction value C is a negative value (step S45: YES), a value obtained by subtracting the high-speed learning update amount SHU from the short-time learning value S(n−1) of the previous control cycle n−1 is assigned to the short-time learning value S(n) of the current control cycle n as shown in the following formula (6) (step S46). In the control cycle immediately after startup of the engine 4, the short-time learning values S(1) and S(0) are both zero and therefore S(1)=−SHU. However, immediately after engine startup, the short-time learning value S(1) may be set equal to zero instead of applying the following formula.

$$S(n)=S(n-1)-SHU \quad (6)$$

If the injection amount correction value C is zero (NO in both steps S43 and S45), the short-time learning value S(n−1) of the previous control cycle is assigned to the short-time learning value S(n) of the current control cycle n (step S47) so that the previous short-time learning value is maintained.

The high-speed learning update amount SHU is set to a comparatively large positive value. The learning speed of the short-time learning value S is thus increased when an injection amount correction value C of large absolute value is set by feedback of the oxygen sensor 33. The absolute value of the injection amount correction value C is thus decreased rapidly.

When the injection amount correction value C is not more than the high-speed learning threshold (step S42: NO), the short-time learning value computing portion 67 updates the short-time learning value S in accordance with the sign of the arithmetic mean value AV of the injection amount correction values C immediately after the respective two immediately previous skips. More specifically, when a skip occurs, the short-time learning value computing portion 67 determines the arithmetic mean value AV of the injection amount correction value C after that skip and the injection amount correction value C after the once previous skip (see FIG. 6). A control value (appropriate value) by which the oxygen concentration inside the exhaust passage 43 is set to the target value is present between the two skips. Therefore, by using the arithmetic mean value AV, the short-time learning value S is updated so as to make the injection amount correction value C approach zero. Specifically, if the arithmetic mean value AV is positive (step S48: YES), a value obtained by adding the short-time learning update amount SU to the short-time learning value S(n−1) of the previous control cycle is assigned to the short-time learning value S(n) of the current control cycle as shown in the following formula (7) (step S49). Here, 0<SU<SHU. Also, SU<Δ (the correction variation amount of the injection amount correction value). In the control cycle immediately after startup of the engine 4, the short-time learning values S(1) and S(0) are both zero and therefore S(1)=+SU. However, immediately after engine startup, the short-time learning value S(1) may be set equal to zero instead of applying the following formula.

$$S(n)=S(n-1)+SU \tag{7}$$

On the other hand, if the arithmetic mean value AV is negative (step S50: YES), a value obtained by subtracting the short-time learning update amount SU from the short-time learning value S(n−1) of the previous control cycle is assigned to the short-time learning value S(n) of the current control cycle as shown in the following formula (8) (step S51). In the control cycle immediately after startup of the engine 4, the short-time learning values S(1) and S(0) are both zero and therefore S(1)=−SU. However, immediately after engine startup, the short-time learning value S(1) may be set equal to zero instead of applying the following formula.

$$S(n)=S(n-1)-SU \tag{8}$$

If the arithmetic mean value AV is zero (NO in both steps S48 and S50), the short-time learning value S(n−1) of the previous control cycle is assigned to the short-time learning value S(n) of the current control cycle (step S52) so that the previous short-time learning value is maintained.

On the other hand, when the feedback control is interrupted (step S41: YES), the short-time learning value computing portion 67 judges whether or not the time elapsed from the interruption of feedback control is less than a predetermined hold time (for example, approximately 300 seconds) (step S53). If the elapsed time is less than the hold time (step S53: YES), the short-time learning value S (n−1) of the previous control cycle is assigned to the short-time learning value S(n) of the current control cycle (step S54) so that the previous short-time learning value S is maintained.

When the elapsed time becomes not less than the hold time (step S53: NO), the short-time learning value computing portion 67 executes a process of decreasing the absolute value of the short-time learning value S by an attenuation amount A (where A>0) at a time.

Specifically, if the short-time learning value S(n−1) of the previous control cycle is positive (step S55: YES), the short-time learning value computing portion 67 assigns a value, obtained by subtracting the attenuation amount A from the short-time learning value S(n−1) of the previous cycle, to the short-time learning value S(n) of the current control cycle (step S56). On the other hand, if the short-time learning value S(n−1) of the previous control cycle is negative (step S57: YES), the short-time learning value computing portion 67 assigns a value, obtained by adding the attenuation amount A to the short-time learning value S(n−1) of the previous cycle, to the short-time learning value S(n) of the current control cycle (step S58). If the short-time learning value S (n−1) of the previous control cycle is zero (NO in both steps S55 and S57), the short-time learning value computing portion 67 assigns the short-time learning value S(n−1) (=0) of the previous cycle to the short-time learning value S(n) of the current control cycle (step S54).

The short-time learning value S(n) that is thus determined is stored in the volatile memory 52V (step S59). The short-time learning value S(n) thus loses its value when the main switch 16 is cut off and the supply of power to the ECU 50 stops.

The short-time learning value S is thus updated such that the injection amount correction value C approaches zero and therefore as the learning proceeds, the injection amount correction value C transitions to the short-time learning value S. Also, when the feedback control is interrupted, the previous short-time learning value S is held for the predetermined hold time and thereafter the short-time learning value S is attenuated. Therefore, during a feedback control interruption of a short time, the short-time learning value S is maintained and an appropriate fuel injection control is thus restarted upon recovery from the feedback control interruption. Also, when the feedback control is interrupted beyond the predetermined hold time, the short-time learning value is gradually attenuated and therefore the short-time learning value is held at a proportion that is in accordance with the interruption time. The short-time learning value is thus reflected in the fuel injection control at a feasible proportion upon recovery from the feedback control interruption.

Figure 8:
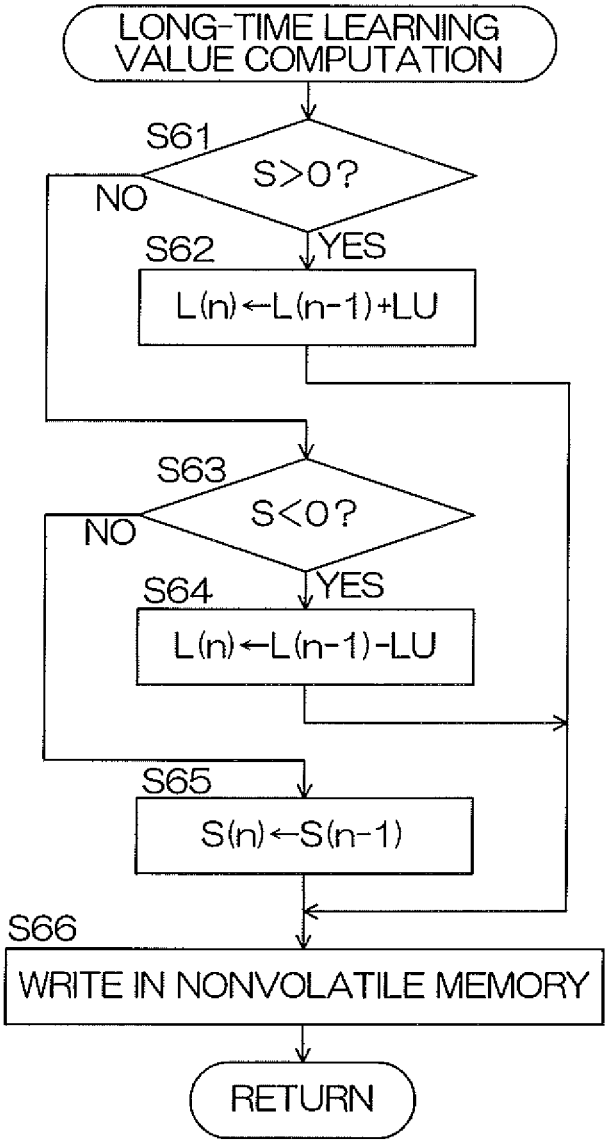
FIG. 8 is a flowchart describing a learning process for a long-time learning value.

FIG. 8 is a flowchart describing a learning process (computation operation of the long-time learning value computing portion 68) for the long-time learning value L. The long-time learning value computing portion 68 updates the long-time learning value L in accordance with the sign of the short-time learning value S. Specifically, if the short-time learning value S is a positive value (step S61: YES), a value obtained by adding the long-time learning update amount LU (where 0<LU<SU) to the long-time learning value L(n−1) of the previous control cycle is assigned to the long-time learning value L(n) of the current control cycle as shown in the following formula (9) (step S62). In the control cycle immediately after startup of the engine 4, the value of the previous operation is loaded as the long-time learning value L(0) from the nonvolatile memory 52N and therefore L(1)=(value of the previous operation)+LU. However, immediately after engine startup, the long-time learning value L(1) may be set equal to L(0)=(value of previous operation) instead of applying the following formula.

$$L(n)=L(n-1)+LU \tag{9}$$

On the other hand, if the short-time learning value S is negative (step S63: YES), a value obtained by subtracting the long-time learning update amount LU from the long-time learning value L(n−1) of the previous control cycle is assigned to the long-time learning value L(n) of the current control cycle as shown in the following formula (10) (step S64). In the control cycle immediately after startup of the engine 4, the value of the previous operation is loaded as the long-time learning value L(0) from the nonvolatile memory 52N and therefore L(1)=(value of the previous operation)−LU. However, immediately after engine startup, the long-time learning value L(1) may be set equal to L(0)=(value of previous operation) instead of applying the following formula.

$$L(n)=L(n-1)-LU \tag{10}$$

If the short-time learning value S is zero (NO in both steps S61 and S63), the long-time learning value L(n−1) of the previous control cycle is assigned to the long-time learning value L(n) of the current control cycle (step S65) so that the previous long-time learning value is maintained. Immediately after engine startup, the longtime learning value of the previous operation is used as it is.

The long-time learning value L(n) that is thus determined is stored in the nonvolatile memory 52N. The value of the long-time learning value L(n) is thus stored even when the main switch 16 is cut off and the supply of power to the ECU 50 stops and is inherited in the learning upon subsequent startup of the engine 4.

The learning computation of the long-time learning value L may be performed while storing the long-time learning value L in the volatile memory 52V. The ECU 50 may write the long-time learning value L in the nonvolatile memory 52N in response to the cutting off of the main switch 16. More specifically, a relay is provided in parallel to the main switch 16 and this relay is controlled by the ECU 50. The ECU 50 thus performs self-holding of the power supply even when the main switch 16 is cut off. Here, in response to the cutting off of the main switch 16, the ECU 50 writes the long-time learning value L in the nonvolatile memory 52N while self-holding the power supply and thereafter cuts off the relay. In regard to the injection amount correction value C and the short-time learning value S, writing in the nonvolatile memory 52N is not required.

As described above, with the arrangement of the present preferred embodiment, the control value of the fuel injection amount is the sum of the feed-forward injection amount and the feedback correction amount, and the feedback correction amount is determined by the sum of the injection amount correction value C, the short-time learning value S, and the long-time learning value L. The injection amount correction value C is determined based on the output of the oxygen sensor 33 that responds to the oxygen concentration inside the exhaust passage 43 and therefore fluctuates promptly in accordance with the state of the exhaust of the engine 4. The short-time learning value S is updated, based on the injection amount correction value C, at the short-time learning speed. That is, the short-time learning speed is defined by the product of the cycle at which the short-time learning value S is updated and the short-time learning update amount SU. The long-time learning value L is updated, based on the short-time learning value S, at the long-time learning speed. That is, the long-time learning speed is defined by the product of the cycle at which the long-time learning value L is updated and the long-time learning update amount LU. The short-time learning speed is faster than the long-time learning speed. That is, the short-time learning value S fluctuates more rapidly than the long-time learning value L.

The injection amount correction value C thus transitions gradually to the short-time learning value S in accordance with the short-time learning speed, and the short-time learning value S gradually transitions to the long-time learning value L in accordance with the long-time learning speed. Influences of long-term fluctuations of the engine state are thus absorbed by the long-time learning value L, influences of medium-term fluctuations of the engine state are absorbed by the short-time learning value S, and influences of short-term fluctuations of the engine state are absorbed by the injection amount correction value C.

Therefore, even if the updating of the injection amount correction value C is interrupted temporarily, an appropriate fuel injection amount that is in accordance with the state of the engine 4 is set using the short-time learning value S and the long-time learning value L. Also, even upon recovery from the interruption of updating of the injection amount correction value C, the injection amount correction value C is required to absorb just the influences of short-term fluctuations and an appropriate fuel injection amount is thus set promptly. The fuel efficiency is thus improved and a state where the air-fuel ratio in the exhaust is close to the theoretical air-fuel ratio is held, and therefore the exhaust purification function by the catalyst 45 is promoted to thus improve the degree of cleanness of the exhaust.

On the other hand, during startup of the engine 4, whereas the long-time learning value L of the previous operation is inherited, the short-time learning value S of the previous operation is not inherited. Influences of the short-time learning are thus prevented from becoming permanent. Further, even if the learning speed is set comparatively high, that is, even if the short-time learning update amount SU is made comparatively large, it will not affect the subsequent operation inadvertently. Also, by providing the short-time learning value S, the learning speed of the long-time learning value L is made sufficiently slow. Therefore, by setting the long-time learning update amount LU to a comparatively small value to make the learning speed of the long-time learning value L sufficiently small, the influences of the medium-term fluctuations of the engine state on the long-time learning value L are reduced. Further, because the long-time learning value L is inherited in the subsequent operation, the injection amount correction value C is thus prevented from taking on an extremely large value even during startup of the engine 4. Appropriate fuel injection control is thus realized even before the feedback control is started or in an open loop control state where the injection amount correction value is temporarily interrupted and the injection amount correction value is reset.

The short-time learning value S is updated so that the injection amount correction value C approaches zero, and therefore the injection amount correction value C transitions to the short-time learning value S. In other words, the short-time learning value S is updated based on the injection amount correction value C so that the injection amount correction value C transitions to the short-time learning value S and approaches toward zero. Also, the long-time learning value L is updated so that the short-time learning value S approaches zero, and therefore the short-time learning value S transitions to the long-time learning value L. In other words, the long-time learning value L is updated based on the short-time learning value S so that the short-time learning value S transitions to the long-time learning value L and approaches toward zero. The injection amount correction value C thus approaches zero as the learning proceeds and the fuel injection control is thus performed appropriately even before the start of feedback control or in an open loop control state where the updating of the injection amount correction value C is interrupted temporarily and the injection amount correction value C is reset.

Also with the present preferred embodiment, when the feedback control using the output of the oxygen sensor 33 is interrupted, the open loop control of computing the control value of the fuel injection amount using the sum of the short-time learning value S and the long-time learning value L as the feedback correction amount is performed. The short-time learning value S is a value that absorbs the medium-term fluctuations of the engine state and therefore appropriate fuel injection control is performed in comparison to a case of using only the long-time learning value L as the feedback correction amount during the open loop control. Also, in recovering from the open loop control to the feedback control, the injection amount correction value C is required to absorb just the influences of the short-term fluctuations of the engine state and its absolute value may thus be small. Appropriate fuel injection control is thus realized rapidly upon recovery to the feedback control.

Further with the present preferred embodiment, the feedback control is interrupted during an air induction operation and during a fuel cut. The oxygen concentration in the exhaust passage 43 during the air induction operation does not reflect the air-fuel ratio in the mixed gas supplied to the engine 4 and it is thus appropriate to interrupt the feedback control. Also, by interrupting the feedback control during the fuel cut in which the fuel injection amount is set to zero, influences of the fuel cut on restart of fuel injection are avoided.

Also with the present preferred embodiment, when the injection amount correction value C is greater than the high-speed learning threshold, the learning speed of the short-time learning value S is increased. Specifically, the short-time learning value S is updated at the high-speed short-time learning speed expressed by the product of the control cycle at which the short-time learning value S is updated and the high-speed learning update amount SHU. The injection amount correction value C is thus made small promptly, and appropriate fuel injection control is thus realized quickly. That is, the injection amount correction value C is made to transition to the short-time learning value S quickly and an appropriate fuel injection amount is thus set in the process of open loop control during interruption of feedback control, etc.

Immediately after engine startup, the short-time learning value S takes on the initial value, and the injection amount correction value C thus takes on a large value due to absorbing the influences of the medium-term fluctuations of the engine 4 as well as the short-term fluctuations thereof. In such a case, the short-time learning value S is updated at a high speed. Appropriate fuel injection control is thus performed promptly.

Also with the present preferred embodiment, the absolute value of the sum of the short-time learning value S and the long-time learning value L is used as the abnormality judgment value, and when the abnormality judgment value exceeds the abnormality threshold TH, it is judged that an abnormality is occurring in the fuel supply system and the indicator 14*a* is lit. The abnormality of the fuel supply system is thus notified to the rider. An abnormality of the fuel supply system is judged based on medium-term and long-term fluctuations of the engine state because the abnormality judgment value is the absolute value of the sum of the short-time learning value S and the long-time learning value L. On the other hand, the injection amount correction value C is not used for the abnormality judgment and the abnormality judgment is thus performed with the exclusion of the influences of short-term fluctuations of the engine state and the probability of erroneous judgment is thus reduced. Moreover, the learning speed of the short-time learning value S is comparatively fast and therefore when an abnormality occurs in the fuel supply system, the abnormality judgment is performed promptly. Also, the learning speed of the long-time learning value L is set to a sufficiently low speed because the learning speed of the short-time learning value S is fast. The abnormality judgment of the fuel supply system is thus performed appropriately without compromising the stability of fuel injection control. Also, with the short-time learning value S, the previous value thereof is not inherited during the startup of the engine 4 and therefore even if the short-time learning value S becomes large due to a temporary phenomenon, it is not inherited in a subsequent operation. Both the fuel supply system abnormality judgment and the fuel injection control is thus performed appropriately.

Figure 9:
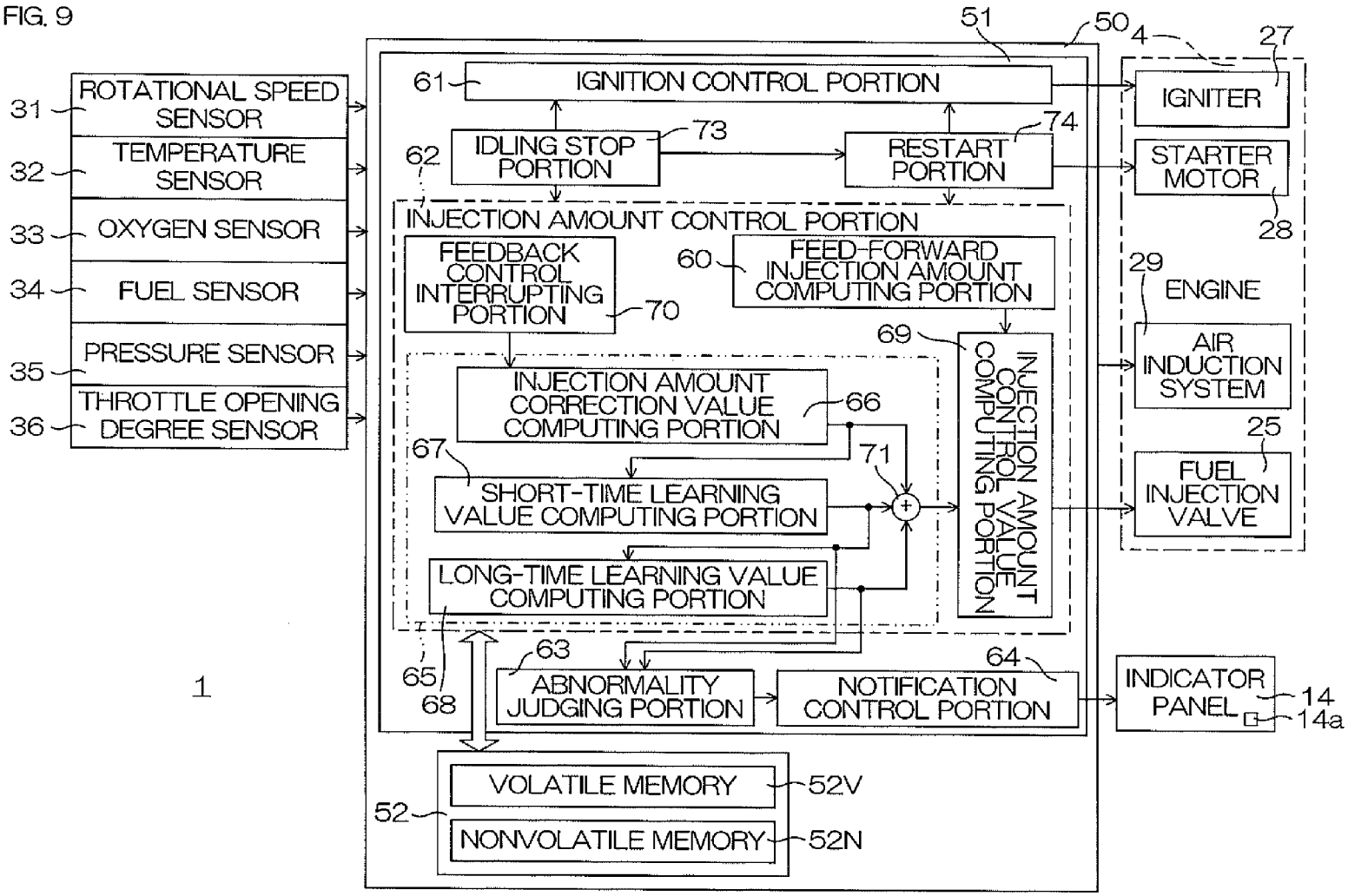
FIG. 9 is a block diagram describing an electrical arrangement of a vehicle to which a fuel injector according to another preferred embodiment of the present invention is applied.

FIG. 9 is a block diagram describing an electrical arrangement of a vehicle to which a fuel injector according to a second preferred embodiment of the present invention is applied. In the description of the second preferred embodiment, FIG. 1 to FIG. 8, described above, shall be referenced again. The arrangement shown in FIG. 9 is used in place of the arrangement of FIG. 3 described above. In FIG. 9, portions corresponding to respective portions shown in FIG. 3 are provided with the same reference symbols and description thereof shall be omitted.

In the present preferred embodiment, the computing portion 51 of the ECU 50 includes, as the function processing units, the ignition control portion 61, the injection amount control portion 62, the abnormality judging portion 63, the notification control portion 64, an idling stop portion 73, and a restart portion 74. The idling stop portion 73 automatically stops the engine 4 when a predetermined idling stop condition is met. The restart portion 74 restarts the engine 4 when a predetermined restart condition is met in an automatic stop state in which the engine 4 is automatically stopped by the idling stop portion 73.

The idling stop condition may be that all of the following conditions A1 to A5 are sustained for a predetermined duration (for example, about 3 seconds).

A1: The throttle opening degree is the fully closed opening degree.

A2: The vehicle velocity is not more than a predetermined value (for example, 3 km/h).

A3: The engine speed is in an idling speed range (for example, not more than 2500 rpm).

A4: The engine temperature is not less than a predetermined value (for example, 60° C.).

A5: The residual amount of the battery 15 is not less than a predetermined value.

The restart condition may be that the throttle opening degree has become not less than a predetermined opening degree. The rider can thus operate the accelerator grip 13 to start cranking of the engine 4 and thus restart the engine 4.

When the engine 4 is automatically stopped by the idling stop portion 73, it may be considered that unlike in the case of an engine stall, the control value of the fuel injection amount is an appropriate value. Therefore, with the present preferred embodiment, when the engine 4 is automatically stopped by the idling stop portion 73, the short-time learning value S is held. Therefore, when the engine 4 is restarted by the restart portion 74, the short-time learning value computing portion 67 restarts the learning operation upon inheriting the previous short-time learning value stored in the volatile memory 52V.

Figure 10:
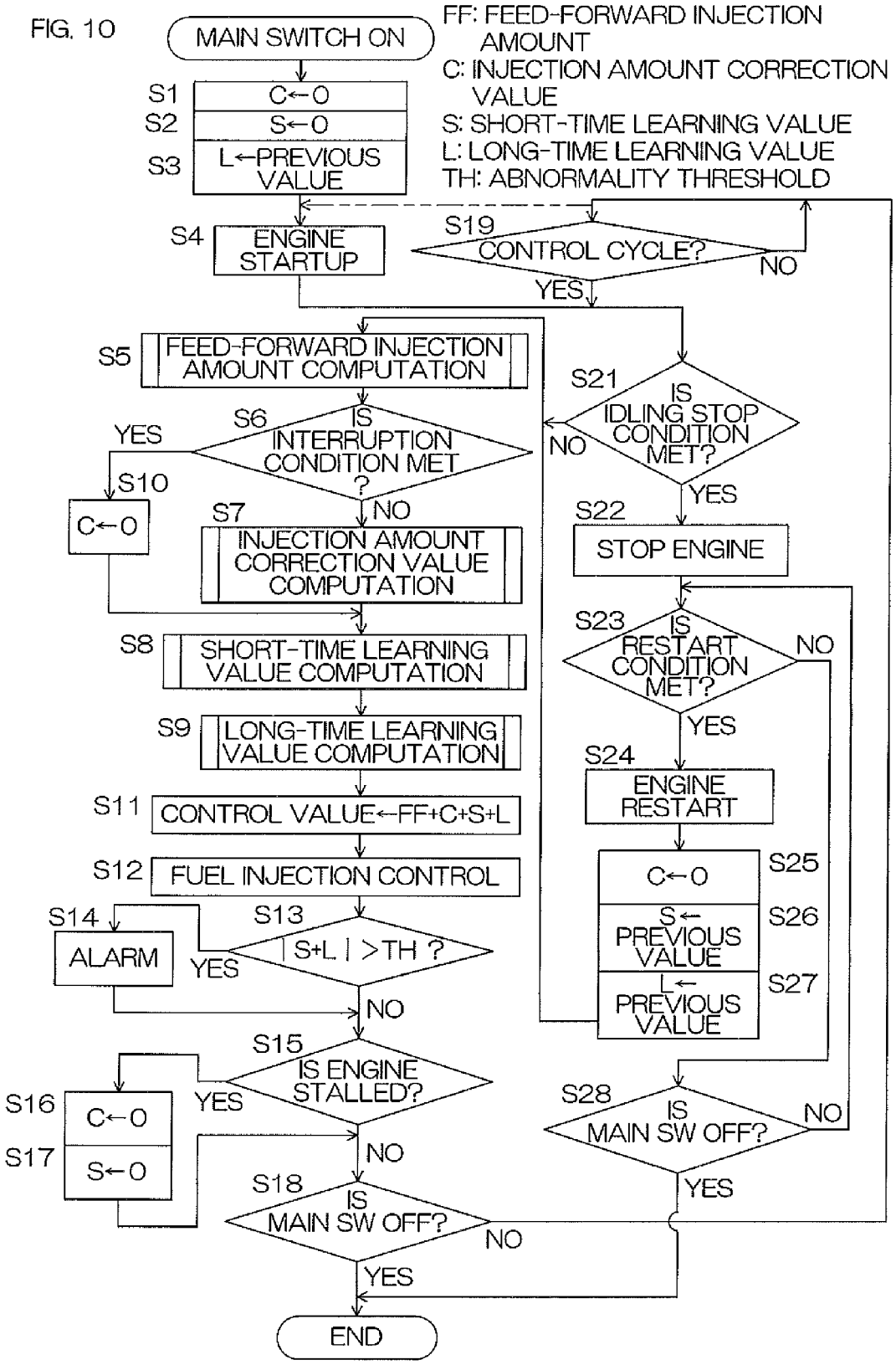
FIG. 10 is a flowchart describing an outline of processes performed by the ECU in the preferred embodiment of FIG. 9.

FIG. 10 is a flowchart describing an outline of processes performed by the ECU 50 in the preferred embodiment of FIG. 9. In FIG. 10, steps in which the same processes as the respective steps shown in FIG. 4 are performed are provided with the same reference symbols and description thereof shall be omitted.

After the engine 4 is started (step S4), whether or not the idling stop condition is met is judged (step S21). If the idling stop condition is not met (step S21: NO), the processes from step S5 are executed. If the idling stop condition is met (step S21: YES), the ECU 50 stops the ignition control and the fuel injection control and automatically stops the engine 4 (step S22). Thereafter, whether or not the restart condition is met is judged (step S23).

If the restart condition is met (step S23: YES), the ECU 50 causes electricity to be supplied to the starter motor 28 to start cranking of the engine 4 and further restarts the ignition control and the fuel injection control to restart the engine 4 (step S24). Thereafter, the injection amount correction value C is reset to zero (step S25). Also, with the short-time learning value S, the value during the previous operation is loaded from the volatile memory 52V and inherited (step S26). Further, with the long-time learning value L, the value during the previous operation is loaded from the nonvolatile memory 52N and inherited (step S27).

If the restart condition is not met (step S23: NO), the ECU 50 judges whether or not the main switch 16 is cut off (step S28). If the main switch 16 is not cut off (step S28: NO), whether or not the restart condition is met is monitored (step S23). If the main switch 16 is cut off (step S28: YES), the ECU 50 executes a predetermined ending process and cuts off the power supply. Therefore, the values of the injection amount correction value C and short-time learning value S held in the volatile memory 52V are lost and the long-time learning value L held in the nonvolatile memory 52N is inherited for fuel injection control.

As described above, with the present preferred embodiment, the fuel efficiency is improved because the engine 4 is automatically stopped by meeting the idling stop condition. When the engine 4 is automatically stopped by the idling stop function, it may be considered that the short-time learning value S held in the volatile memory 52V is of an appropriate value. Therefore, when the engine is restarted from the engine automatic stop state due to the idling stop function, the previous short-time learning value S is inherited and the control value for the fuel injection amount is determined using this short-time learning value S. The fuel injection control after engine restart is thus performed appropriately immediately after the restart.

On the other hand, if the engine 4 is not automatically stopped by the idling stop control but the engine 4 is stopped due to the fuel injection control, etc., being inappropriate, the previous short-time learning value S is not inherited in the subsequent engine startup (steps S14 and S16). The previous short-time learning value S, which may be inappropriate, is thus discarded and appropriate learning is started anew.

Although preferred embodiments of the present invention have been described above, the present invention may be carried out in yet other modes. For example, with each of the preferred embodiments, the short-time learning value S preferably is stored in the volatile memory 52V and disappears when the supply of power to the ECU 50 is cut off. However, there is no problem in storing the short-time learning value S in the nonvolatile memory 52N. In this case, when the engine 4 is first started after the power is turned on, the ECU 50 initializes the previous short-time learning value S to zero.

In further examples shown in FIG. 4 and FIG. 10 described above, the injection amount correction value C and the short-time learning value S preferably are initialized (steps S1 and S2) and the long-time learning value L is loaded (step S3) before the engine startup (step S4). However, a portion or all of the processes of steps S1, S2, and S3 may be executed after the engine startup.

Also, with each of the preferred embodiments, the short-time learning speed and the long-time learning speed preferably are mainly set by setting the short-time learning update amount SU and long-time learning update amount LU. However, the learning speeds may also be set by setting the updating cycles in place of setting the learning update amounts SU or LU, or together with the setting of the learning update amounts SU or LU.

Further, the short-time learning value S determined as in each of the preferred embodiments may be multiplied or divided by a factor (a constant or a variable), and a value obtained through such calculation may be used as the "short-time learning value." Similarly, a value obtained by multiplying or dividing the long-time learning value L, determined as in each of the preferred embodiments, by a factor (a constant or a variable) may be used as the "long-time learning value." Yet further, it suffices that the control value of the fuel injection amount be computed using a sum of the injection amount correction value, the short-time learning value of fast learning speed, and the long-time learning value of slow learning speed. The computation of the injection amount correction value, the short-time learning value, and the long-time learning value is not restricted to the examples of the preferred embodiments.

The present application claims priority to Japanese Patent Application No. 2013-060591 filed on Mar. 22, 2013 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fuel injection controller for controlling a fuel injection amount of a fuel injector in an engine of a vehicle, the fuel injection controller comprising:

an oxygen sensor that responds to an oxygen concentration inside an exhaust passage through which an exhaust of the engine passes; and an injection amount control unit programmed to control the fuel injection amount based on an output of the oxygen sensor, wherein the injection amount control unit includes:

an injection amount correction value computing unit that determines an injection amount correction value based on the output of the oxygen sensor, the injection amount correction value having a correction variation amount added thereto or subtracted therefrom based on the output of the oxygen sensor;

a short-time learning value computing unit that determines, based on the injection amount correction value, a short-time learning value that is updated at a predetermined short-time learning speed;

a long-time learning value computing unit that determines, based on the short-time learning value, a long-time learning value that is updated at a long-time learning speed that is slower than the short-time learning speed;

a feedback correction amount computing unit that computes a feedback correction amount based on a sum of the injection amount correction value, the short-time learning value, and the long-time learning value;

an injection amount control value computing unit that computes a control value of the fuel injection amount using the feedback correction amount; and a long-time learning value holding unit that stores the long-time learning value; wherein when the engine is started, the long-time learning value computing unit reads and uses a previous long-time learning value stored in the long-time learning value holding unit prior to when the engine is started, while the short-time learning value computing unit starts computing the short-time learning value anew without inheriting a previous short-time learning value.

2. The fuel injection controller according to claim 1, wherein the short-time learning value computing unit updates the short-time learning value so that the injection amount correction value approaches zero, and the long-time learning value computing unit updates the long-time learning value such that the short-time learning value approaches zero.

3. The fuel injection controller according to claim 1, wherein the injection amount control unit includes a feedback control interrupting unit that interrupts the determining by the injection amount correction value computing unit when a predetermined interruption condition is established to interrupt the feedback control based on the output of the oxygen sensor;

the short-time learning value computing unit stores the short-time learning value for a predetermined hold time when the feedback control is interrupted and, when a time during which the feedback control is interrupted reaches the predetermined hold time, makes the short-time learning value approach zero; and the feedback correction amount computing unit computes a sum of the short-time learning value and the long-time learning value as the feedback correction amount when the feedback control is interrupted.

4. The fuel injection controller according to claim 3, wherein the feedback control interrupting unit interrupts the feedback control when an air induction operation of introducing air into the exhaust passage is being performed and when a fuel cut control of setting the fuel injection amount to zero is being performed.

5. The fuel injection controller according to claim 1, wherein, when an absolute value of the injection amount correction value is greater than a predetermined high-speed learning threshold, the short-time learning value computing unit updates the short-time learning value at a high-speed short-time learning speed that is faster than the short-time learning speed.

6. The fuel injection controller according to claim 1, further comprising an abnormality judging unit that compares an absolute value of a sum of the short-time learning value and the long-time learning value with a predetermined abnormality threshold to judge whether or not there is an abnormality in a fuel supply system of the engine.

7. A fuel injection controller for controlling a fuel injection amount of a fuel injector in an engine of a vehicle, the fuel injection controller comprising:

an oxygen sensor that responds to an oxygen concentration inside an exhaust passage through which an exhaust of the engine passes;

an injection amount control unit programmed to control the fuel injection amount based on an output of the oxygen sensor, wherein the injection amount control unit includes:

an injection amount correction value computing unit that determines an injection amount correction value based on the output of the oxygen sensor;

a short-time learning value computing unit that determines, based on the injection amount correction value, a short-time learning value that is updated at a predetermined short-time learning speed;

a long-time learning value computing unit that determines, based on the short-time learning value, a long-time learning value that is updated at a long-time learning speed that is slower than the short-time learning speed;

a feedback correction amount computing unit that computes a feedback correction amount based on a sum of the injection amount correction value, the short-time learning value, and the long-time learning value;

an injection amount control value computing unit that computes a control value of the fuel injection amount using the feedback correction amount; and a long-time learning value holding unit that stores the long-time learning value;

an idling stop unit that automatically stops the engine when a predetermined idling stop condition is met; and a restart unit that restarts the engine when a predetermined restart condition is met in an automatic stop state; wherein the automatic stop state, in which the engine is automatically stopped by the idling stop unit, is entered in response to the predetermined idling stop condition including an engine speed in an idling speed range;

when the engine is restarted by the restart unit, the short-time learning value computing unit inherits the previous short-time learning value; and when the engine is started in a state other than the automatic stop state, the long-time learning value computing unit reads and uses a previous long-time learning value stored in the long-time learning value holding unit prior to when the engine is started in the state other than the automatic stop state, while the short-time learning value computing unit starts computing the short-time learning value anew without inheriting a previous short-time learning value.

8. The fuel injection controller according to claim 1, wherein the injection amount correction value has a first skip variation amount added thereto in response to the output of the oxygen sensor switching from a rich signal to a lean signal;

the injection amount correction value has a second skip variation amount subtracted therefrom in response to the output of the oxygen sensor switching from a lean signal to a rich signal; and the first skip variation amount and the second skip variation amount are each greater than the correction variation amount.

9. The fuel injection controller according to claim 1, wherein the short-time learning value computing unit determines an arithmetic mean of injection amount correction values corresponding to two consecutive switches of the output of the oxygen sensor between a lean signal and a rich signal;

the short-time learning value computing unit adds a short-time learning update amount to the short-time learning value when the arithmetic mean is positive; and the short-time learning value computing unit subtracts the short-time learning update amount from the short-time learning value when the arithmetic mean is negative.

10. The fuel injection controller according to claim 1, wherein the predetermined short-time learning speed is slower than a rate of change of the injection amount correction value.

* * * * *